US005560154A

United States Patent [19]

Matarazzo

[11] Patent Number: 5,560,154

[45] Date of Patent: Oct. 1, 1996

[54] WINDOW CLOSURE WITH IMPROVED WEATHERSTRIPPING COMBINATION ARRANGEMENT

[75] Inventor: Robert P. Matarazzo, Chicopee, Mass.

[73] Assignee: Custom Wood Reproductions, Inc., Springfield, Mass.

[21] Appl. No.: 249,885

[22] Filed: May 26, 1994

[51] Int. Cl.[6] ..... E06B 7/16

[52] U.S. Cl. ..... 49/484.1; 49/406; 49/483.1; 49/489.1

[58] Field of Search ..... 49/484.1, 483.1, 49/406, 458, 489.1, 475.1

[56] References Cited

U.S. PATENT DOCUMENTS

| | | | |
|---|---|---|---|
| 378,778 | 2/1888 | Dodge . | |
| 795,120 | 7/1905 | Harris et al. . | |
| 815,941 | 3/1906 | Dawson . | |
| 915,445 | 3/1909 | Kammerer | 49/406 X |
| 1,004,336 | 9/1911 | Athey | 49/483.1 X |
| 1,247,432 | 11/1917 | Lunken . | |
| 1,352,545 | 9/1920 | Schnekenburger . | |
| 1,547,493 | 7/1925 | Dunham . | |
| 1,590,974 | 12/1925 | Hall . | |
| 1,600,150 | 9/1926 | Suttle . | |
| 1,635,678 | 7/1927 | Jurasinski . | |
| 1,686,101 | 10/1928 | Oakley | 49/406 |
| 1,726,576 | 9/1929 | McVeety . | |
| 1,745,245 | 1/1930 | Cobel . | |
| 1,751,679 | 3/1930 | Barringer | 49/406 |
| 1,762,514 | 6/1930 | Glaser et al. | 49/483.1 |
| 1,877,729 | 9/1932 | Chaffee . | |
| 1,910,695 | 5/1933 | Horn . | |
| 1,947,352 | 2/1934 | Macklanburg . | |
| 1,950,037 | 3/1934 | Schaefer . | |
| 1,986,701 | 1/1935 | Zimmermann | 49/484.1 X |
| 2,093,754 | 9/1937 | Fauner | 49/406 |
| 2,158,298 | 5/1939 | Oftedal et al. . | |
| 2,189,960 | 2/1940 | Montgomery et al. . | |
| 2,549,284 | 4/1951 | Baker . | |
| 2,729,315 | 1/1956 | Morgann et al. . | |
| 2,843,233 | 7/1958 | Walsh . | |
| 2,888,721 | 6/1959 | Hagerty . | |
| 3,060,526 | 10/1962 | Nardulli | 49/406 |
| 3,173,179 | 3/1965 | Edwards | 49/484.1 X |
| 3,271,902 | 9/1966 | Dunsmoor et al. | 49/483.1 |
| 3,325,944 | 6/1967 | Crain . | |
| 3,944,693 | 3/1976 | Ungerer . | |
| 4,096,665 | 6/1978 | Ellingson, Jr. . | |
| 4,381,627 | 5/1983 | Cichonski . | |
| 4,464,864 | 8/1984 | Yackiw | 49/406 X |
| 4,538,380 | 9/1985 | Colliander . | |
| 4,712,330 | 12/1987 | Beirnes . | |
| 4,716,683 | 1/1988 | Minter . | |
| 4,726,147 | 2/1988 | Beske et al. . | |
| 4,802,308 | 2/1989 | Hitzig . | |

FOREIGN PATENT DOCUMENTS

| | | | |
|---|---|---|---|
| 1300133 | 12/1962 | France . | |
| 569150 | 11/1957 | Italy | 49/484.1 |
| 522878 | 6/1940 | United Kingdom . | |
| 2170253 | 7/1986 | United Kingdom . | |

*Primary Examiner*—Philip C. Kannan
*Attorney, Agent, or Firm*—Antonelli, Terry, Stout & Kraus

[57] ABSTRACT

A double-hung window closure is disclosed having a weatherstripping combination arrangement affording a high level of weather and draft resistance protection. At least two levels of weather and draft resistance protection is provided along each of the window edges and include combinations of the following types of weatherstripping: metal weatherstripping, silicone bead weatherstripping and pile weatherstripping.

20 Claims, 13 Drawing Sheets

WINDOW CLOSURE WITH IMPROVED WEATHERSTRIPPING COMBINATION ARRANGEMENT

BACKGROUND OF THE INVENTION

1. Field of the Invention

The subject invention relates in general to closures with an improved weatherstripping arrangement, and more particularly, to a double-hung window closure with an improved weatherstripping combination arrangement.

2. Description of Related Art

Restoration of old buildings for historical, zoning and economical reasons has gained in frequency in recent years. A part of such building restoration entails closure (i.e., windows, doors, etc.)restoration, typically through closure reproductions (i.e., replacements) such that an aesthetic appearance and character of the building is maintained. While it is desirable to maintain the closure reproductions as closely as possible to original appearances and configurations, it is also desirable to improve and maximize as much as possible a weather and draft resistance protection and energy efficiency of such closure reproductions for improved closure durability and improved building performance and economy.

The following represents a listing of known related art pertaining to weatherstrips or seals useable with closures, and/or weatherstripping arrangements with respect to closures:

U.S. Pat. No. 378,778 issued to G. P. DODGE on Feb. 28, 1888;

U.S. Pat. No. 795,120 issued to W. M. HARRIS ET AL. on Jul. 18, 1905;

U.S. Pat. No. 815,941 issued to F. Y. DAWSON on Mar. 27, 1906;

U.S. Pat. No. 1,247,432 issued to E. H. LUNKEN on Nov. 20, 1917;

U.S. Pat. No. 1,352,545 issued to W. SCHNEKENBURGER on Sep. 14;

U.S. Pat. No. 1,547,493 issued to J. C. DUNHAM on Jul. 28, 1925;

U.S. Pat. No. 1,590,974 issued to J. G. S. HALL on Jun. 29, 1926;

U.S. Pat. No. 1,600,150 issued to C. M. SUTTLE on Sep. 14, 1926;

U.S. Pat. No. 1,635,678 issued to T. L. JURASINSKI on Jul. 12, 1927;

U.S. Pat. No. 1,726,576 issued to C. McVEETY on Sep. 3, 1929;

U.S. Pat. No. 1,745,245 issued to J. H. COBEL on Jan. 28, 1930;

U.S. Pat. No. 1,877,729 issued to E. F. CHAFFEE on Sep. 13, 1932;

U.S. Pat. No. 1,910,695 issued to H. R. HORN on May 23, 1933;

U.S. Pat. No. 1,947,352 issued to L. A. MACKLANBURG on Feb. 13, 1934;

U.S. Pat. No. 1,950,037 issued to J. SCHAEFER on Mar. 6, 1934;

U.S. Pat. No. 2,158,298 issued to P. R. OFTEDAL ET AL. on May 16, 1939;

U.S. Pat. No. 2,189,960 issued to J. R. MONTGOMERY ET AL. on Feb. 13, 1940;

U.S. Pat. No. 2,549,284 issued to H. N. BAKER on Apr. 17, 1951;

U.S. Pat. No. 2,729,315 issued to R. 0. MORGANN ET AL. Jan. 3, 1956;

U.S. Pat. No. 2,843,233 issued to W. L. WALSH on Jul. 15, 1958;

U.S. Pat. No. 2,888,721 issued to A. T. HAGERTY on Jun. 2, 1959;

U.S. Pat. No. 3,325,944 issued to P. CRAIN on Jun. 20, 1967;

U.S. Pat. No. 3,944,693 issued to A. J. UNGERER on Mar. 16, 1976;

U.S. Pat. No. 4,096,665 issued to C. W. ELLINGSON, JR. on Jun. 27, 1978;

U.S. Pat. No. 4,381,627 issued to W. E. CICHONSKI on May 3, 1983;

U.S. Pat. No. 4,538,380 issued to A. C. COLLIANDER on Sep. 3, 1985;

U.S. Pat. No. 4,712,330 issued to J. R. BEIRNES on Dec. 15, 1987;

U.S. Pat. No. 4,716,683 issued to M. J. MINTER on Jan. 5, 1988;

U.S. Pat. No. 4,726,147 issued to S. R. BESKE ET AL. on Feb. 23, 1988;

U.S. Pat. No. 4,802,308 issued to G. HITZIG on Feb. 7, 1989; GB Patent 522,878 issued to S. PERCIVAL during Jun. 1940; UK Patent application GB 2,170,253 having C. S. Ingram et al listed as an inventorship and published Jul. 30, 1986;

FR Patent 1,300,133 issued to M. V. Freschi on Jun. 25, 1962.

The teachings of each of the above-listed U.S. Patents (which does not itself incorporate essential material by reference) are herein incorporated by reference.

While closures implementing the above-mentioned weatherstripping arrangements provide some degree of weather and draft resistance protection, there still exists a need for closures offering even higher levels of weather and draft resistance protection, durability and energy efficiency, thus to result in improved building performance and economy. Even more particularly, as double-hung window closures typically represent a substantial number of closures within many buildings, there exists a need for a double-hung window closure offering high levels of weather and draft resistance protection, durability and energy efficiency, thus to result in improved building performance and economy.

SUMMARY OF THE INVENTION

This invention is directed toward satisfying the aforementioned needs with respect to closures in general, and with respect to double-hung window closures in particular.

Accordingly, it is an object of the present invention to provide closures having improved weatherstripping arrangements offering even higher levels of weather and draft resistance protection, durability and energy efficiency.

A second object of the present invention is to provide closures having improved weatherstripping arrangements resulting in improved building performance and economy.

An even more particular object of the present invention is to provide double-hung window closures having improved weatherstripping combination arrangements offering even higher levels of weather and draft resistance protection, durability and energy efficiency.

A further particular object of the present invention is to provide double-hung window closures having improved weatherstripping combination arrangements resulting in improved building performance and economy.

Applicant accomplishes the foregoing objects through the provision of a unique and novel combination invention, which in a broad sense, is directed to a window closure comprising: a mating transom rigid weatherstrip and a transom flexible seal provided between a transom and a transom sash member; a mating jamb rigid weatherstrip and a jamb flexible seal provided between a jamb and stile sash members; a mating sill rigid weatherstrip and a sill flexible seal provided between a window sill and a sill sash member.

In an intermediate sense, Applicant's invention is directed to a double-hung window closure comprising: a transom metal weatherstrip having in cross-section, a protruding tongue portion, the transom metal weatherstrip being provided with respect to one of a transom and a transom sash member of an upper sash, and an opposite one of the transom and a transom sash member having a tongue receiving groove defined therein for insertably receiving the protruding tongue portion of the transom metal weatherstrip; a transom resilient seal provided with respect to one of the transom and the transom sash member to provide a resilient seal therebetween; a first jamb metal weatherstrip having in cross-section, a protruding tongue portion, said first jamb metal weatherstrip being provided with respect to one of a first jamb and upper right and left stile sash members of the upper sash, and an opposite one of the first jamb and the upper fight and left stile sash members having a tongue receiving groove defined therein for slidingly receiving the protruding tongue portion of the first jamb metal weatherstrip; a first stile pile seal provided with respect to one of the first jamb and the upper fight and left stile sash members to provide a pile seal therebetween; a check rail weatherstrip provided between a first check rail sash member of the upper sash and a second check rail sash member of a lower sash, to provide a seal therebetween; a second jamb metal weatherstrip having in cross-section, a protruding tongue portion, the second jamb metal weatherstrip being provided with respect to one of a second jamb and lower fight and left stile sash members of the lower sash, and an opposite one of the second jamb and the lower fight and left stile sash members having a tongue receiving groove defined therein for slidably receiving the protruding tongue portion of the second jamb metal weatherstrip; a second stile pile seal provided with respect to one of the second jamb and the lower fight and left stile sash members to provide a pile seal therebetween; a sill metal weatherstrip having in cross-section, a protruding tongue portion, the sill metal weatherstrip being provided with respect to one of a window sill and a sill sash member of the lower sash, and an opposite one of the window sill and the sill sash member having a tongue receiving groove defined therein for insertably receiving the protruding tongue portion of the sill metal weatherstrip; and a sill resilient seal provided with respect to one of the window sill and the sill sash member to provide a resilient seal therebetween.

Finally, in a narrower sense, Applicant's invention is directed to a double-hung window closure comprising: a transom metal weatherstrip having in cross-section, a main body portion and a protruding tongue portion, the transom metal weatherstrip being provided in a first transom channel; a first jamb metal weatherstrip having in cross-section, a main body portion, a protruding tongue portion, a wrap-around portion provided substantially at one end of the main body, and at least two metal weatherstrip ridges provided along the main body and defining a valley therebetween, the first jamb metal weatherstrip being provided in a first jamb channel which is aligned with the first transom channel; a second jamb metal weatherstrip having in cross-section, a main body portion, a protruding tongue portion, a wrap-around portion provided substantially at one end of the main body, and at least two metal weatherstrip ridges provided along the main body and defining a valley therebetween, the second jamb metal weatherstrip being provided in a second jamb channel which is aligned with a second transom channel; a separator bead disposed between the first jamb channel and the second jamb channel; a sill metal weatherstrip having in cross-section, a main body portion and a protruding tongue portion, the sill metal weatherstrip being provided along a window sill and being aligned with the second jamb channel; an upper sash comprising a transom sash member, an upper right stile sash member, an upper left stile sash member and a first check rail sash member, the transom sash member having a tongue receiving groove defined therein for insertably receiving the protruding tongue portion of the transom metal weatherstrip, a transom resilient seal retention groove defined therein and a transom resilient seal provided with respect to the transom resilient seal retention groove, the transom resilient seal being compressively deformable between the transom sash member and the transom metal weatherstrip to provide a seal therebetween, the upper fight stile sash member and the upper left stile sash member each having a tongue sliding groove defined therein for slidingly receiving the protruding tongue portion of the first jamb metal weatherstrip, a first stile pile seal retention groove defined therein, a first stile pile seal provided with respect to the first stile pile seal retention groove, the first stile pile seal being slidable with respect to the valley defined in the first jamb metal weatherstrip and providing a pile seal between the first jamb metal weatherstrip and each of the upper fight stile sash member and the upper left stile sash member, and a stile sash portion disposed between the wrap-around portion and the protruding tongue portion of the transom metal weatherstrip, and the first check rail sash member having a rabbeted portion defined therein, and a first check rail weatherstrip provided with respect to the rabbeted portion; a lower sash comprising a second check rail sash member, a lower fight stile sash member, a lower left stile sash member and a sill sash member, the second check rail sash member having a second check rail weatherstrip, the second check rail weatherstrip for slidingly engaging the first check rail weatherstrip, the lower fight stile sash member and the lower left stile sash member each having a tongue sliding groove defined therein for slidingly receiving the protruding tongue portion of the second jamb metal weatherstrip, a second stile pile seal retention groove defined therein, a second stile pile seal provided with respect to the second stile pile seal retention groove, the second stile pile seal being slidable with respect to the valley defined in the second jamb metal weatherstrip and providing a pile seal between the second jamb metal weatherstrip and each of the lower fight stile sash member and the lower left stile sash member, and a stile sash portion disposed between the wrap-around portion and the protruding tongue portion of the second jamb metal weatherstrip, and the sill sash member having a tongue receiving groove defined therein for insertably receiving the protruding tongue portion of the sill metal weatherstrip, a sill resilient seal retention groove defined therein and a sill resilient seal provided with respect to the sill resilient seal retention groove, the sill resilient seal being compressively deformable between the sill sash member and the sill metal weatherstrip to provide a seal therebetween; a check rail pile seal provided with respect to at least one of the separator bead, the first check rail sash member and the second check rail sash member to provide a pile seal between the separator bead and at least one of the first check rail sash member and the second check rail sash member; a sash stop provided facing surfaces of the lower right stile sash member and the lower left stile sash member, the sash stop having a stop pile seal retention groove defined therein, a stop pile seal provided with respect to the stop pile seal retention groove, the stop pile seal providing a pile seal between the sash stop and each of the lower right stile sash member and the lower left stile sash member which are slidable with respect to the sash stop; and a stool cap provided adjacent the sill sash member, the stool cap having a cap pile seal retention groove defined therein, a cap pile seal provided with respect to the cap pile seal retention groove, the cap pile seal providing a pile seal between the stool cap and the sill sash member.

The foregoing and other objects, advantages, manner of operation, novel features and a better understanding of the present invention will become apparent from the following detailed description of the preferred embodiments and claims when read in connection with the accompanying drawings, all forming a part of the disclosure hereof this invention. While the foregoing and following written and illustrated disclosure focuses on disclosing embodiments of the invention which are considered preferred embodiments at the time the patent application was filed in order to teach one skilled in the art to make and use the invention, and to otherwise satisfy the best mode disclosure requirements under U.S. patent law, it should be clearly understood that the same is by way of illustration and example only and is not to be taken by way of limitation, the spirit and scope of the present invention being limited only by the terms of the appended claims.

BRIEF DESCRIPTION OF THE DRAWING(S)

The following represents brief descriptions of the drawings, wherein.

DETAILED DESCRIPTION OF THE PREFERRED EMBODIMENTS OF THE INVENTION

Figure 1:
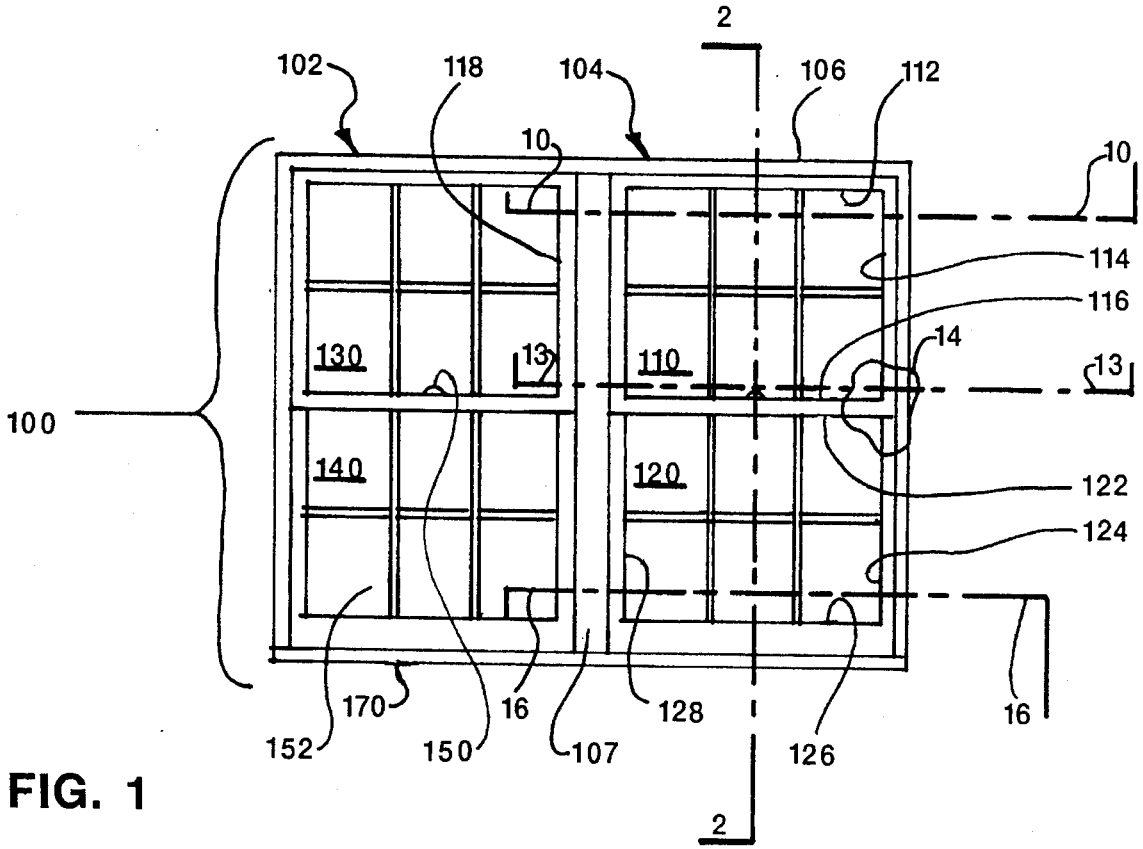
FIG. 1 is a front view of a twin double-hung window closure incorporating a preferred weatherstripping combination arrangement of the present invention.

Before beginning a detailed description of the subject invention, mention of the following is in order:

When appropriate, like reference numerals and characters are used to designate identical, corresponding or similar components in differing figure drawings. Further, reference numerals and characters which are offset by multiples of 100 (e.g., 210, 510, 910, etc.) are sometimes used to designate identical, corresponding or similar components in differing figure drawings or construction locations within the invention.

The figure drawings associated with this disclosure typically are not drawn with dimensional accuracy or to scale, i.e., such drawings have been drafted with a focus on clarity of viewing and understanding rather than dimensional accuracy. An attempt has been made specifically to point out any dimensions, tolerances, etc. which are important.

Within the following discussions, terms of relative directions (e.g., top, bottom, left, fight) are used. All such terms of relative directions are meant to be interpreted with respect to a placement of a double-hung window closure in a normal operative position, with: a window sill representing a "bottom" or "lower" direction; a transom representing a "top" or "upper" direction; and "fight" and "left" being defined with respect to a viewing of the double-hung window closure from a point of view external to a building looking toward the double-hung window closure.

Turning now to a detailed description of a preferred embodiment of the invention, FIG. 1 is a front view of a twin double-hung window closure incorporating a preferred weatherstripping combination arrangement of the present invention. More particularly, there are illustrated a twin double-hung window closure 100 including a left double-hung window 102 and a fight double-hung window 104 defined between a transom, lintel or head 106 and a sill 170 and separated by a mullion 107. With further particularity, the fight double-hung window 104 includes an upper sash 110 constructed of a horizontal transom sash member 112, a vertical stile sash member 114, a check rail or meeting rail 116 and a stile sash member 118, and further includes a lower sash 120 constructed of a check rail or meeting rail 122, a vertical stile sash member 124, a horizontal sill sash member 126 and a vertical stile sash member 128. The left double-hung window 102 contains an upper sash 130 and lower sash 140 having constructions similar to those of the upper sash 110 and the lower sash 120, respectively. Further illustrated in FIG. 1 are a window lock 150, muntins or sash bars 152 and a window sill 170. Axes 2—2', 10—10', 13—13' and 16—16' and emphasized area 14 are discussed ahead with respect to other figure drawings.

Figure 2:
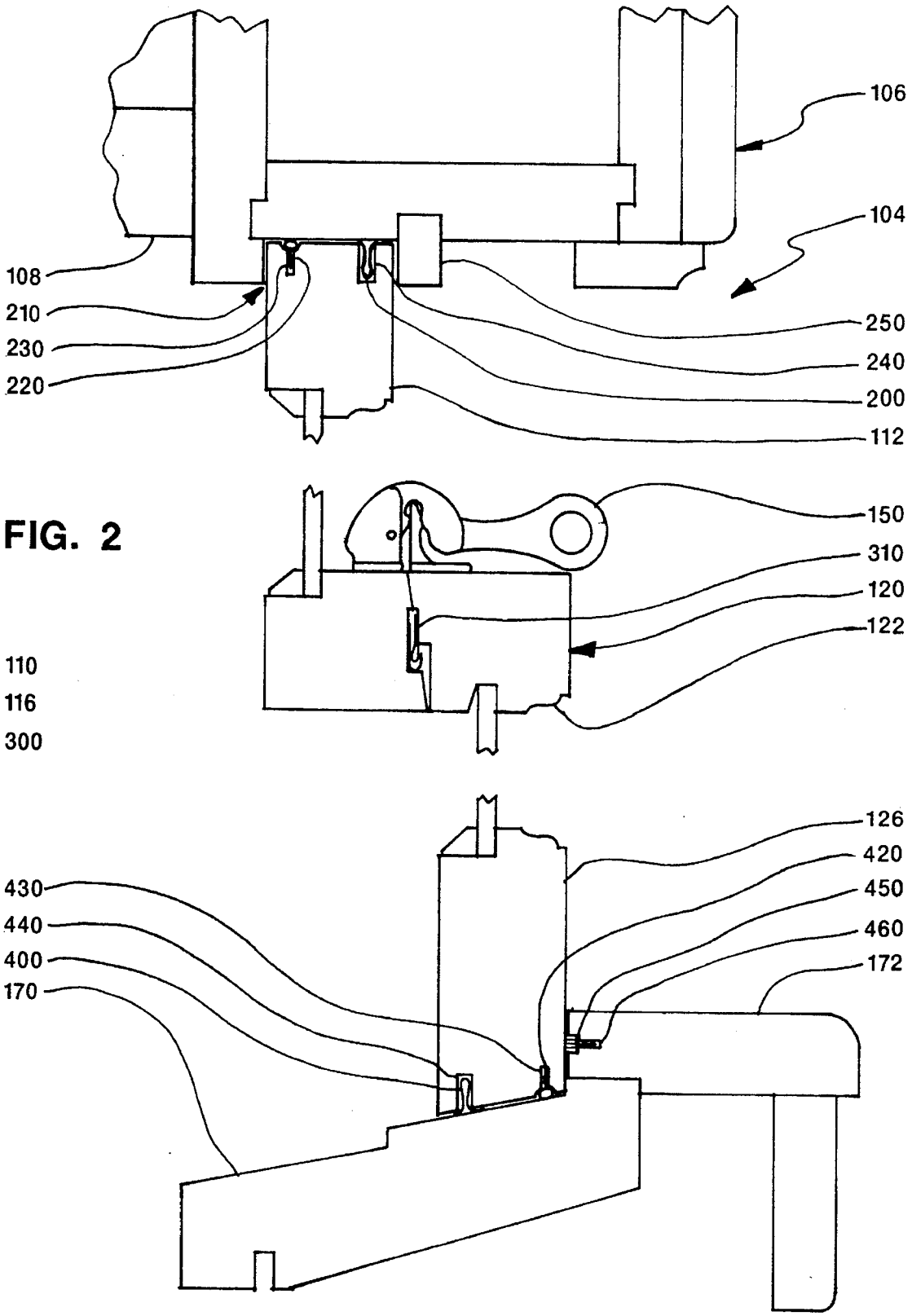
FIG. 2 is a cross-sectional view of the double-hung window closure of FIG. 1 taken along a central vertical axis 2—2' and illustrates a portion of a preferred weatherstripping combination arrangement of the present invention.

FIG. 2 is a cross-sectional view of the double-hung window closure of FIG. 1 taken along a central vertical axis 2—2' and illustrates a portion of a preferred weatherstripping combination arrangement of the present invention. More particularly, in an upper part of such FIG. 2, there is illustrated a vertical cross-section of the horizontal transom sash member 112 of an upper sash 110, which horizontal transom sash member 112 is disposed with respect to a transom, lintel or head 106. Further, the check rail 116 of the upper sash 110 is shown disposed in abutting relation with respect to the check rail 122 of the lower sash 120. Finally, the horizontal sill sash member 126 is shown disposed with respect to the sill 170 and a stool cap 172.

Figure 3:
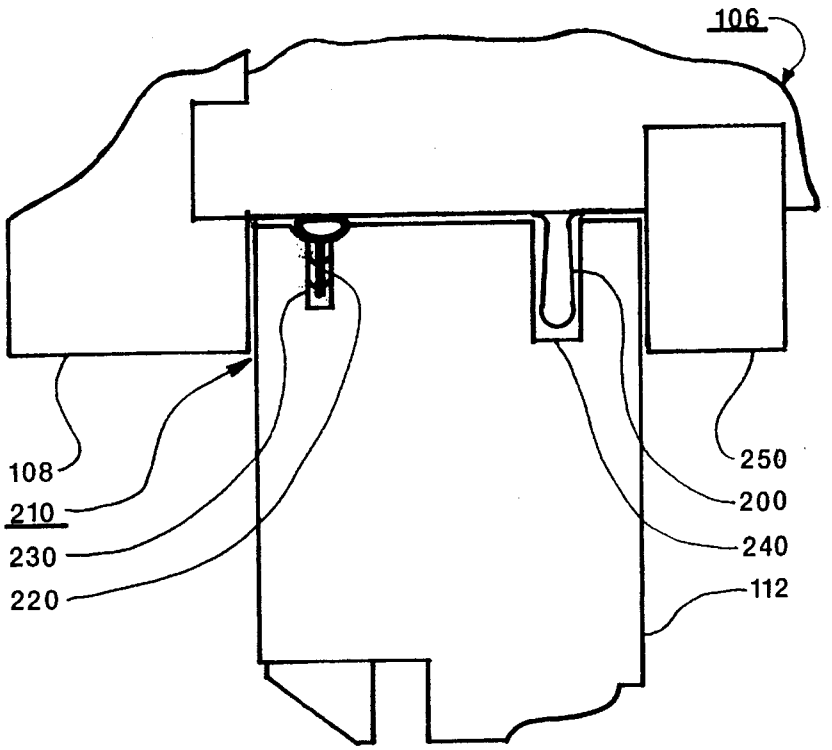
FIG. 3 is an enlarged, partial cross-sectional view of the double-hung window closure of FIG. 1 taken along an upper portion of the central vertical axis 2—2' and illustrates a portion of a preferred weatherstripping combination arrangement of the present invention.

In the interest of more clearly disclosing an arrangement of component parts with respect to the horizontal transom sash member 112, FIG. 3 is an enlarged, partial cross-sectional view of the double-hung window closure of FIG. 1 taken along an upper portion of the central vertical axis 2—2' and illustrates a portion of a preferred weatherstripping combination arrangement of the present invention. Relatedly, FIG. 4 is an exploded view corresponding to FIG. 3 for the purpose of illustrating component parts and arrangements thereof in greater clarity and detail.

Figure 4:
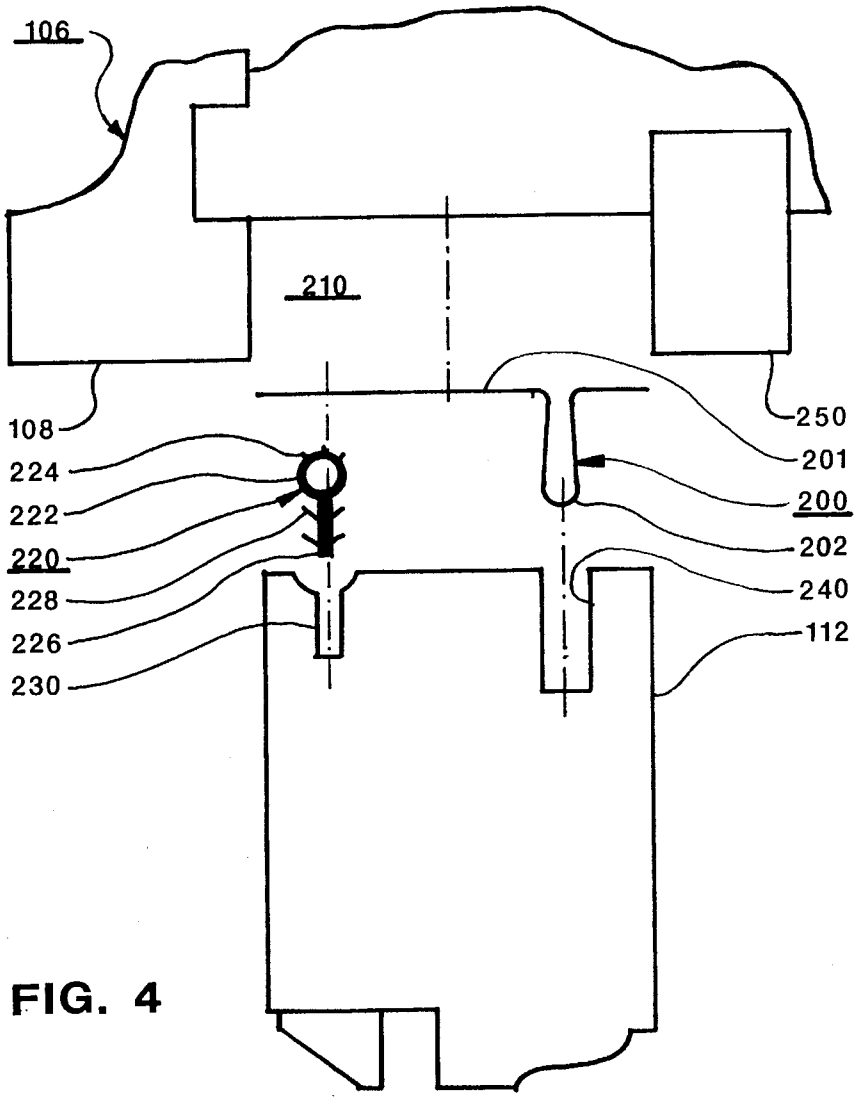
FIG. 4 is an exploded view corresponding to FIG. 3 for the purpose of illustrating component part and arrangements thereof in greater clarity and detail.

More particularly, in FIGS. 3 and 4 there are shown a cross-section of a longitudinal transom metal weatherstrip 200 which is received and retained within a transom channel 210 defined in the transom 106, between a sash stop 108 and a transom parting bead or transom separator molding 250. The transom metal weatherstrip 200 preferably extends longitudinally along an entire to right-to-left horizontal length of the transom channel 210 from a right window jamb to a left window jamb (with the jambs illustrated most clearly in cross-sectional view in FIG. 10), however, the transom metal weatherstrip may also extend for a lesser length. Further, such weatherstrip component is preferably provided as a single unitary length without longitudinal joints or splices therealong.

Further, the transom metal weatherstrip 200 preferably is constructed to have along a cross-section transverse to a longitudinal axis thereof, a flat metal weatherstrip contact body 201 with a metal weatherstrip tongue 202 extending therefrom. As a less preferred embodiment, the transom metal weatherstrip 200 can have a complex-shaped metal weatherstrip contact body, e.g., raised ridges which sealingly contact or otherwise fit into corresponding valleys defined in the horizontal transom sash member 112, a wrap-around portion for contacting an additional surface of the horizontal transom sash member 112. Care must be taken to insure that the transom metal weatherstrip 200 does not interfere with the ability to move the upper sash 110 to a fully window closed position.

The metal weatherstrip tongue 202 is preferably a simple hollow U or loop shape to afford slight flexibility thereto, but may also be solid and may also be of any other desired protruding shape.

The transom metal weatherstrip 200 should be made of a material which affords weather and wear resistance and durability, e.g., the transom metal weatherstrip 200 is preferably made of a zinc material. Alternatively, a different metal or non-metal material may be substituted therefor, e.g., a molded plastic weatherstrip, as long as such material provides a desired weather resistance and durability.

The transom metal weatherstrip 200 is retained within the transom channel by any of different well known retention arrangements, e.g., through use of an adhesive, nails, screws, etc.

In a preferred embodiment at the time of filing a patent application for the present invention, a preferred transom metal weatherstrip is a commercially available weatherstrip, i.e., model #3X, called "HEAD WEATHERSTRIP", available from a manufacturer named ACCURATE METAL WEATHERSTRIP CO., INC. located in Mount Vernon, N.Y., and is retained within the transom channel using ⅞" zinc nails.

Next, there are shown the horizontal transom sash member 112 having a transom weatherstrip receiving groove 240 and a transom resilient weatherstrip retention groove 230 formed in a transom contacting surface thereof. The horizontal transom sash member 112 is preferably made of wood, but also may be made of other materials, e.g., metal, molded plastic, etc.

The transom weatherstrip receiving groove 240 is preferably arranged to extend longitudinally along an entire right-to-left length of the horizontal transom sash member 112, and is arranged to align with, and insertably and removably receive, the metal weatherstrip tongue 202 as the upper sash 110, and accordingly, the horizontal transom sash member 112, is moved upward to a closed transom-contacting position. Preferably, the transom weatherstrip receiving groove 240 has, in a cross-section transverse to a longitudinal axis thereof, a simple rectangularly-shaped groove which can be formed, e.g., using a router. Alternatively, the transom weatherstrip receiving groove 240 may have a complex shape, e.g., a shape which facilitates a removably interlocking relation with a complex-shaped metal weatherstrip tongue as further mentioned ahead.

The metal weatherstrip tongue 202 is preferably arranged to have a slightly loose fit within the transom weatherstrip receiving groove 240, but also may be slightly larger in width than the transom weatherstrip receiving groove 240 or can otherwise have a spring biasing arrangement to sealingly contact with at least one of the side surfaces and/or opening facing surface of the transom weatherstrip receiving groove 240. A further possible embodiment is envisioned wherein the metal weatherstrip tongue 202 and transom weatherstrip receiving groove 240 releasably interlock using a spring biasing arrangement, e.g. a springy compressive tongue having a wider width toward a tip of the tongue, which wider tongue portion interlocks into a wider width portion of a receiving groove.

The metal weatherstrip tongue 202, in a normal received position within the transom weatherstrip receiving groove 240 (as shown most clearly in FIG. 3), affords a first level of weather and draft resistance protection by serving as a barrier to weather and draft penetration between external and internal environments of opposing sides of the double-hung window 104 by a sealing contact between the metal weatherstrip tongue 202 and the transom weatherstrip receiving groove 240, or by representing an elongated path along which weather and draft penetrations must travel along between the external and internal environments.

The transom resilient weatherstrip retention groove 230 preferably extends along an entire longitudinal right-to-left length of the horizontal transom sash member 112, and preferably has, in a cross-section transverse to a longitudinal axis thereof, a widened Y-shape cross-section which can be formed, e.g., using a router. Alternatively, the transom weatherstrip retention groove 230 may have a different shape or may be provided for a lesser length.

Further shown in FIGS. 3 and 4, is a transom resilient weatherstrip seal 220 (shown in a cross-section transverse to a longitudinal axis thereof) for insertion and retention within the transom resilient weatherstrip retention groove 230 of the horizontal transom sash member 112. With further particularity, the transom resilient weatherstrip seal 220 is constructed of a resilient seal main body 222 which extends longitudinally along the longitudinal transom resilient weatherstrip seal 220 and preferably is hollow, but may be of other suitable configurations which afford compressive resiliency. The transom resilient weatherstrip seal 220 further includes resilient seal ridges or protrusions 224 which extend longitudinally along the longitudinal transom resilient weatherstrip seal 220 and are meant to sealingly contact the transom metal weatherstrip 200 at the metal weatherstrip contact body 201. In a preferred arrangement, the transom resilient weatherstrip seal 220 includes three or more resilient seal ridges 224.

The transom resilient weatherstrip seal 220 further includes a resilient seal retention body 226 and resilient seal retention arms 228, both of which preferably extend longitudinally along an entire longitudinal length of the transom resilient weatherstrip seal 220, but may extend for lesser or intermittent lengths. The resilient seal retention body 226 is utilized for insertion into the transom resilient weatherstrip retention groove 230, and supports the resilient seal retention arms 228 which contact walls of the transom resilient weatherstrip retention groove 230 to maintain (i.e., anchor) the transom resilient weatherstrip seal 220 therein. The transom resilient weatherstrip seal 220 is preferably retained (i.e., anchored) within the transom resilient weatherstrip retention groove 230 solely by the resilient seal retention arms 228 in order to facilitate replacement of the transom resilient weatherstrip seal 220 if necessary, but may also be permanently secured within the transom resilient weatherstrip retention groove 230 through various well known approaches, e.g., through use of an adhesive.

The transom resilient weatherstrip seal 220 preferably extends as a single unitary length without interruption or joints along an entire right-to-left length of the horizontal transom sash member 112. The transom resilient weatherstrip seal 220 is and preferably is made of a silicone material affording weather resistance, long-life, durability and compressive resiliency, but may also be made of other types of resilient materials, e.g., rubber.

In a preferred embodiment at the time of filing a patent application for the present invention, a preferred transom resilient weatherstrip seal is a commercially available weatherstrip, i.e., model #WS10–20, called "TUBE SEAL", available from a manufacturer named RESOURCE CONSERVATION TECHNOLOGY, INC. located in Baltimore, Md., and is retained within the transom resilient weatherstrip retention groove using a press fit.

As can be seen most clearly in FIG. 3, when the upper sash 110, and accordingly, the horizontal transom sash member 112, is positioned upward in a fully closed transom contacting position, the transom resilient weatherstrip seal 220 is compressively deformed (i.e., squeezed) between the horizontal transom sash member 112 and the transom metal weatherstrip 200 to provide a pressured seal therebetween. Such pressured seal provides a second level of weather and draft resistant protection with respect to external and internal environments on opposing sides of the horizontal transom sash member 112.

Figure 5:
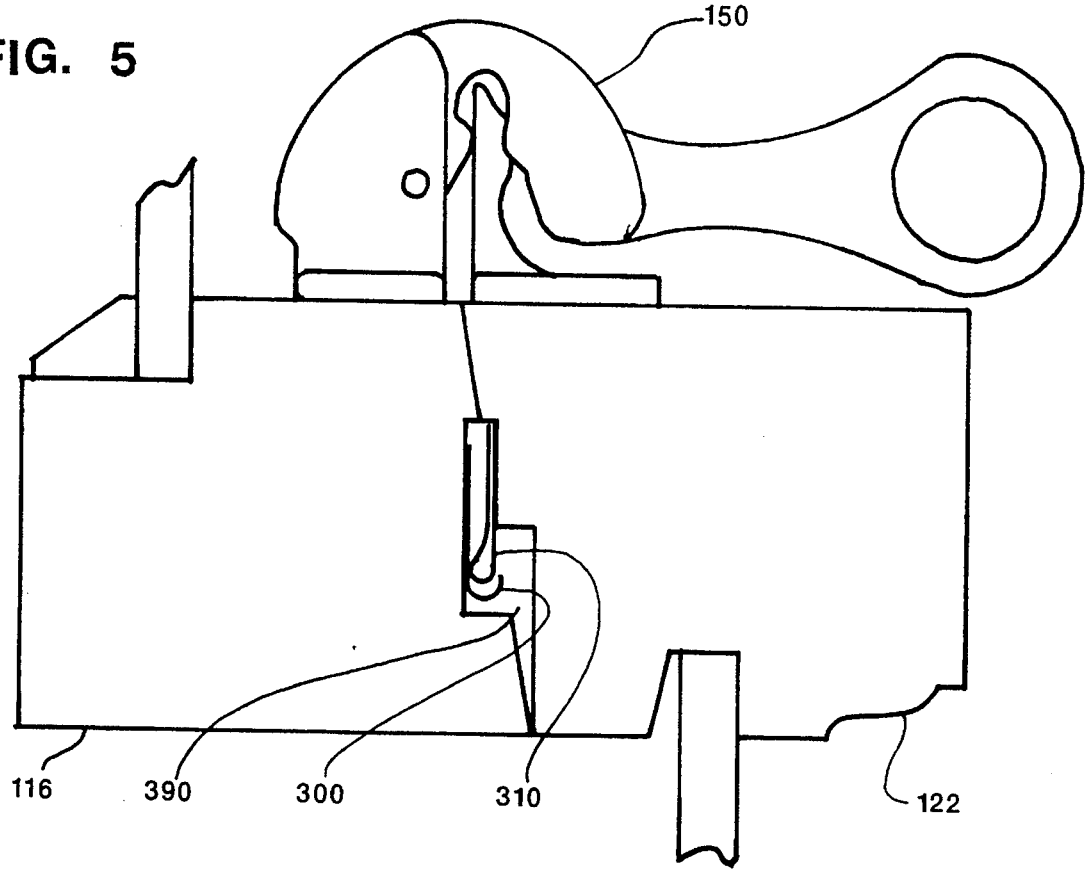
FIG. 5 is an enlarged, partial cross-sectional view of the double-hung window closure of FIG. 1 taken along a mid portion of the central vertical axis 2—2' and illustrates a portion of a preferred weatherstripping combination arrangement of the present invention.
Figure 6:
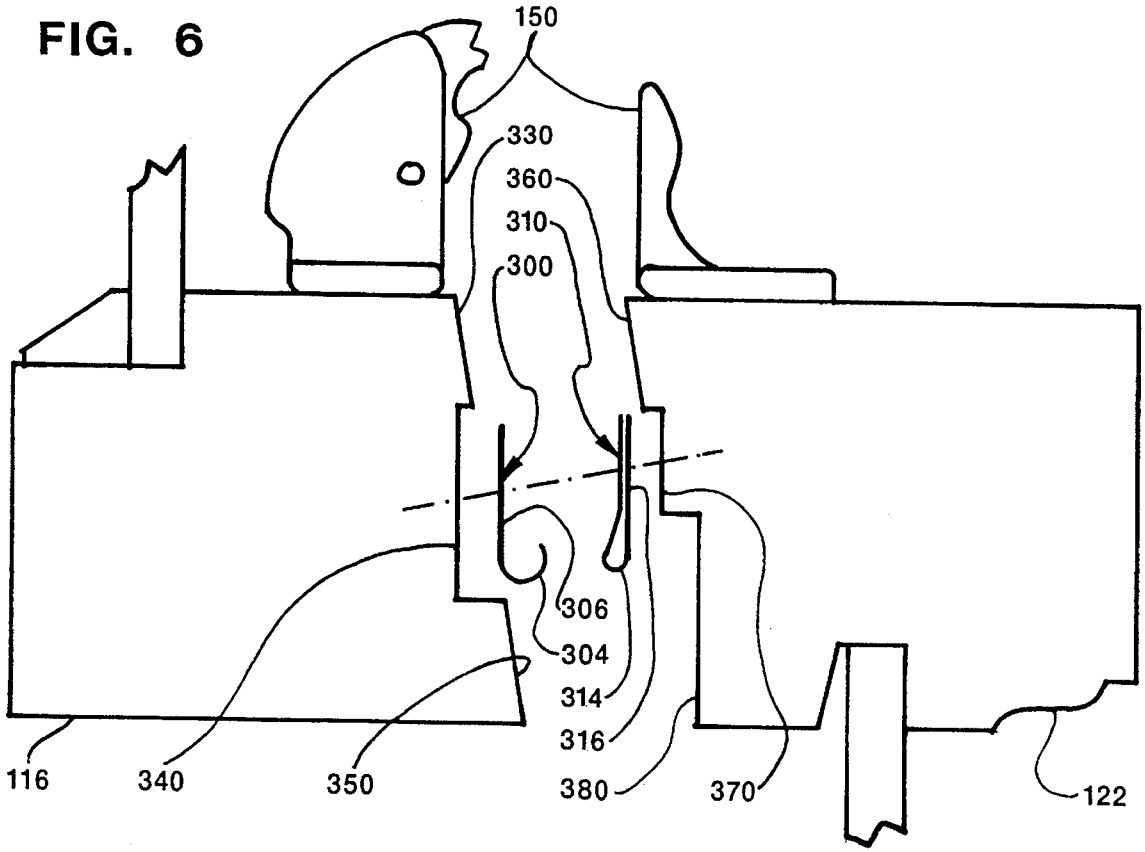
FIG. 6 is an exploded view corresponding to FIG. 5 for the purpose of illustrating component parts and arrangements thereof in greater clarity and detail.

Turning now to a disclosure of a weatherstripping arrangement with respect to a check rail portion, FIG. 5 is an enlarged, partial cross-sectional view of the double-hung window closure of FIG. 1 taken along a mid portion of the central vertical axis 2—2' and illustrates a portion of a preferred weatherstripping combination arrangement of the present invention. Relatedly, FIG. 6 is an exploded view corresponding to FIG. 5 for the purpose of illustrating component parts and arrangements thereof in greater clarity and detail.

More particularly, there are shown a check rail 116 having a bevelled portion 330, a rabbet portion 340 and a bevelled portion 350, and in an abutting, opposing relation thereto (in a normally closed window position, a check rail 122 is illustrated as having a beveled portion 360, a first stepped portion 370 and a second stepped portion 380. In the aforementioned normally closed window position, the beveled portions 330 and 360 abuttingly contact each other and a lower edge of the beveled portion 350 and the second stepped portion 380 contact each other. The beveled portion 330, rabbet portion 340, beveled portion 350, beveled 360, first stepped portion 370 and second stepped portion 380 extend along a substantial majority of a fight-to-left horizontal length of the check rail 116 and check rail 122, such length being defined between a left parting bead or separator molding 252 and a fight parting bead or separator molding 254 (see FIG. 13).

Using a window lock 150 to lock and bias the check rail 116 and check rail 122 together, the contacting and opposing beveled portions 330 and 360 and the beveled portion 350 and second step portion 380 afford a first level of weather and draft resistance protection for the check rail portion of the window with respect to external and internal environments on opposing sides of the double-hung window 102.

In a preferred embodiment, rabbet portion 340, beveled portion 350, first step portion 370 and second stepped portion 380 define a longitudinal check rail weatherstrip gap 390 (see FIG. 5) extending longitudinally along the immediately aforementioned length. Disposed within the check rail weatherstrip gap 390 is a hook metal weatherstrip 300 and loop metal weatherstrip 310 both extending longitudinally along a majority of a length of the check rail 116 and check rail 122 as defined between a left parting bead 252 and a fight parting bead 254 (again see FIG. 13). Further, such weatherstrip components are each preferably provided as a single unitary length without longitudinal joints or splices therealong.

The hook metal weatherstrip 300 is arranged to have the shape of, in a cross-section transverse to a longitudinal axis thereof, a metal weatherstrip hook portion 304 and a metal weatherstrip mounting body 306, and preferably is made of a zinc material for weather resistance and durability, but may also made of other metal and non-metal materials, e.g., molded plastic. The hook metal weatherstrip 300 is secured to the rabbet portion 340 of the check rail 116 through any of well known approaches, e.g., through use of an adhesive, nails, screws, etc. The loop metal weatherstrip 310 is arranged to have the shape of, in a cross-section transverse to a longitudinal axis thereof, a metal weatherstrip loop portion 314 and a metal weatherstrip mounting body 316, and is preferably made of a zinc material for weather resistance and durability, but may also be made of other metal and non-metal materials, e.g., molded plastic.

The hook metal weatherstrip 300 and loop metal weatherstrip 310 have a sliding mating or engagement relationship, with an engagement and disengagement thereof being effected as the upper sash 110 (and therefore the check rail 116) and the lower sash 120 (and therefore the check rail 122) are displaced vertically with respect to one another. A normal engagement is effected in a normally closed window position as illustrated most clearly in FIG. 5

The loop metal weatherstrip 310 is preferably arranged or biased to provide some degree of sealing contact with the hook metal weatherstrip 300, e.g., through use of a width of the metal weatherstrip loop portion 314 slightly wider than a width of the metal weatherstrip hook portion 304, or through biased contact between surfaces of hook metal weatherstrip 300 and loop metal weatherstrip 310. Care must be taken to make sure that the loop metal weatherstrip 310 has sufficient clearance from any protruding portion of the beveled portion 330 as the metal loop weatherstrip 310 transitions past the beveled portion 330 during a vertical displacement of the check rail 116 and check rail 122 with respect to one another i.e., during an opening and closing of the window.

In a preferred embodiment at the time of filing a patent application for the present invention, a preferred hook metal weatherstrip and loop metal weatherstrip is a commercially available weatherstrip, i.e., model #7 and 8, called "MEETING RAIL", available from a manufacturer named ACCURATE METAL WEATHERSTRIP CO., INC. located in Mount Vernon, N.Y., and is retained within the check rail weatherstrip gap using ⅞" zinc nails.

The hook metal weatherstrip 300 and loop metal weatherstrip 310 arrangement in an engaged, normally window closed position, affords a second level of weather and draft resistance protection for the check rail portion of the window.

Figure 7:
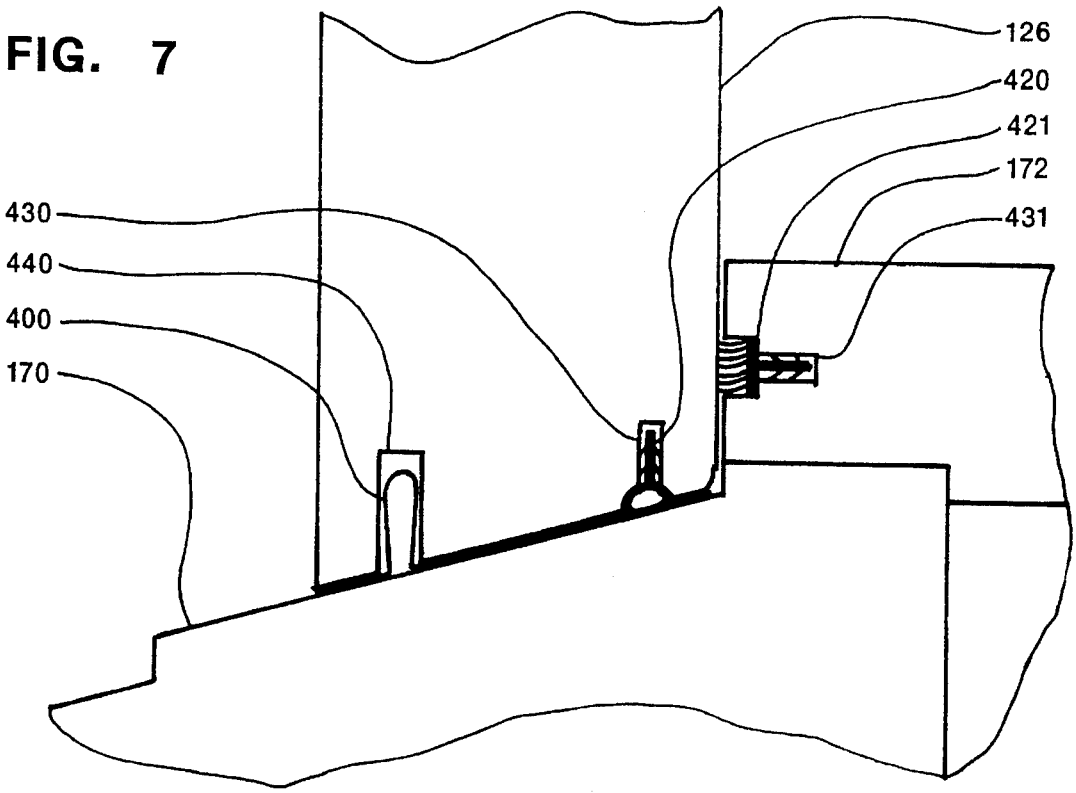
FIG. 7 is an enlarged, partial cross-sectional view of the double-hung window closure of FIG. 1 taken along a lower portion of the central vertical axis 2—2' and illustrates a portion of a preferred weatherstripping combination arrangement of the present invention.
Figure 8:
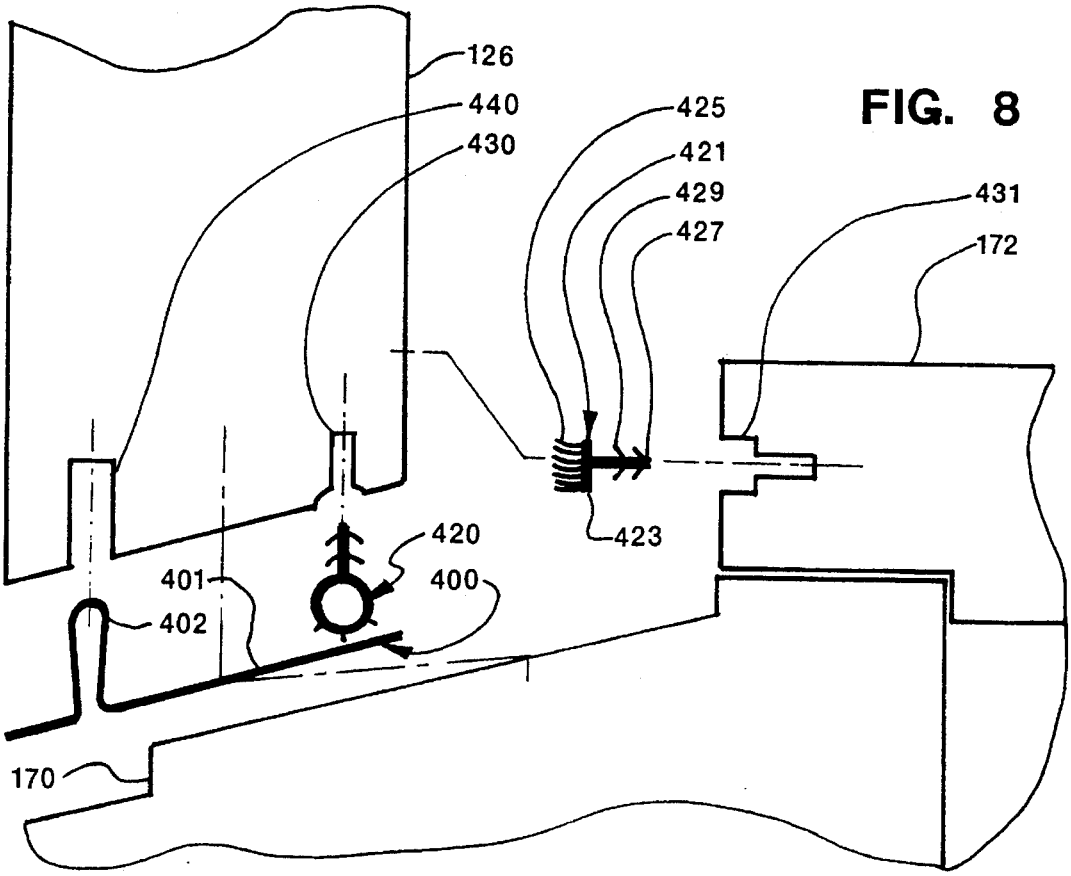
FIG. 8 is an exploded view corresponding to FIG. 7 for the purpose of illustrating component parts and arrangements thereof in greater clarity and detail.
Figure 9:
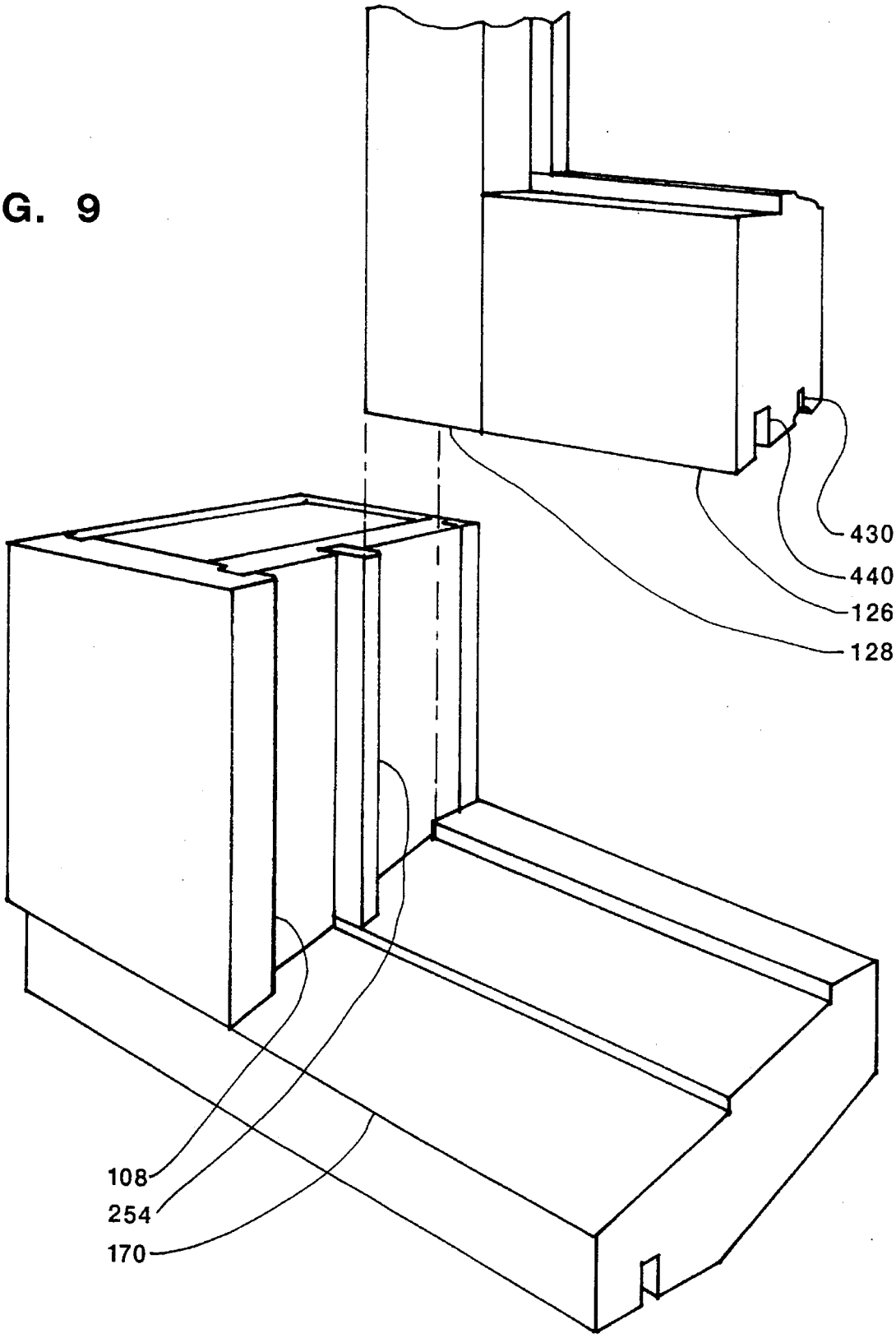
FIG. 9 is a perspective, partial sectional view of a lower portion of the double-hung window closure of FIG. 1 for the purpose of illustrating weatherstrip receiving and retention grooves and other component parts and arrangements thereof in greater clarity and detail.

Turning now to a description of the weatherstrip arrangement of a lower sill portion, FIG. 7 is an enlarged, partial cross-sectional view of the double-hung window closure of FIG. 1 taken along a lower portion of the central vertical axis 2—2' and illustrates a portion of a preferred weatherstripping combination arrangement of the present invention. Relatedly, FIG. 8 is an exploded view corresponding to FIG. 7 for the purpose of illustrating component parts and arrangements thereof in greater clarity and detail. Similarly, FIG. 9 is a perspective, partial sectional view of a lower portion of the double-hung window closure of FIG. 1 for the purpose of illustrating weatherstripping receiving and retention grooves and other component parts and arrangements thereof in greater clarity and detail.

More particularly, with respect to such FIGS. there are illustrated a horizontal sash member 126, a sill 170, a stool cap 172, a sill metal weatherstrip 400, metal weatherstrip contact body 401, metal weatherstrip tongue 402, resilient seal weatherstrip 420, resilient weatherstrip retention groove 430 and sill weatherstrip receiving groove 440. A description of the components 400, 401, 402, 420, 430, and 440 would substantially parallel the foregoing description with respect to the components 200, 201, 202, 220, 230 and 240, respectively, and accordingly, redundant discussion thereof is omitted for the sake of brevity. However, the following supplemental discussion is provided with respect to the sill metal weatherstrip 400.

More particularly, the metal weatherstrip tongue 402 of the sill metal weatherstrip 400 is provided at an angle with respect to a plane of the metal weatherstrip contact body 401 in order to adjust for any slope of the sill 170 and to accurately align with the sill weatherstrip receiving groove 440. Further, perforations of holes may be provided at appropriate locations along the sill metal weatherstrip 400 in order to allow drainage of any water collecting in a valley defined between said metal weatherstrip tongue 402 and an upper slope of the sill 170, although such holes may lessen a weather and draft resistance protection afforded by the sill metal weatherstrip 400.

In a preferred embodiment at the time of filing a patent application for the present invention, a preferred sill metal weatherstrip is a commercially available weatherstrip, i.e., model #3X, model name "SILL WEATHERSTRIP", available from a manufacturer named ACCURATE METAL WEATHERSTRIP CO., INC. located in Mount Vernon, N.Y., and is retained on the sill using ⅞" zinc nails. Similarly, a preferred resilient seal weatherstrip is a commercially available weatherstrip, i.e., model #WS10–20, called "TUBE SEAL", available from a manufacturer named RESOURCE CONSERVATION TECHNOLOGY, INC. located in Baltimore, Md., and is retained within the resilient weatherstrip retention groove using a press fit.

Further illustrated in FIGS. 7 and 8 is a cross-section of a cap pile weatherstrip seal 421 inserted and retained within a cap pile weatherstrip retention groove 431 defined within the stool cap 172. The cap pile weatherstrip retention groove 431 in a preferred embodiment preferably extends along substantially an entire right-to-left length of the stool cap 172 as defined between the right window jamb and left window jamb (see FIG. 10 for best view of the right and left window jambs), but may be provided for a shorter length. Similarly, the cap pile weatherstrip seal 421 in a preferred embodiment extends, preferably as a single unitary length without longitudinal joints or splices therealong, along substantially an entire length of the pile weatherstrip retention groove.

With further particularity the cap pile weatherstrip seal 421 is constructed to have a pile seal main body 423 having secured thereto, pile seal bristles 425 which brushingly and slidingly contact and create a pile seal with the horizontal sill sash member 126. In a preferred embodiment, the pile seal main body is preferably constructed of a vinyl material, and the pile seal bristles 425 are preferably construed of a polypropylene material, both materials affording a high degree of weather resistance and durability, and the pile seal bristles 425 are attached to the pile seal main body 423 via fusing.

The cap pile weatherstrip seal 421 further includes a pile seal retention body 427 and pile seal retention arms 429, both of which preferably extend longitudinally along an entire longitudinal length of the cap pile weatherstrip seal 421, but may extend for lesser or intermittent lengths. The pile seal retention body 427 is utilized for insertion into the cap pile weatherstrip retention groove 431, and supports the pile seal retention arms 429 which contact side walls of the cap pile weatherstrip retention groove 431 to maintain (i.e., anchor) the cap pile weatherstrip seal 421 therein. The cap pile weatherstrip seal 421 is preferably retained (i.e., anchored) within the cap pile weatherstrip retention groove 431 solely by the pile weatherstrip retention arms 429 in order to facilitate replacement of the cap pile weatherstrip seal 421 if necessary, but may also be permanently secured within the cap pile weatherstrip retention groove 431 through various well-known approaches, e.g., through use of an adhesive. The pile seal retention body 427 and pile seal retention arms 429 are preferably a same material as a main material of the pile seal main body 423.

In a preferred embodiment at the time of filing a patent application for the present invention, a preferred pile weatherstrip seal is a commercially available weatherstrip, i.e., model #114WT, model name "KERF MOUNTED PILE", available from a manufacturer named Amesbury located in Amesbury, Mass., and is retained within the pile weatherstrip retention groove using a press fit.

As can be seen most clearly in FIG. 7, when the lower sash 120, and accordingly, the horizontal sill sash member 126, is positioned downwardly in a fully closed sill contacting position, the cap pile weatherstrip seal 421 is compressively and/or angularly deformed by the contacting surface of the horizontal sill sash member 126 to provide a pressurized seal therebetween. Such pressurized seal provides a second level of weather and draft resistance protection with respect to external and internal environments on opposing sides of the double-hung window 104.

Turning now to FIG. 9, of particular interest, a cross-section of the resilient weatherstrip retention groove 430 and the sill weatherstrip receiving groove 440 are illustrated in perspective view. The transom resilient weatherstrip retention groove 230 and the transom weatherstrip receiving groove 240 along the transom sash member 112 have a similar arrangements.

Figure 10:
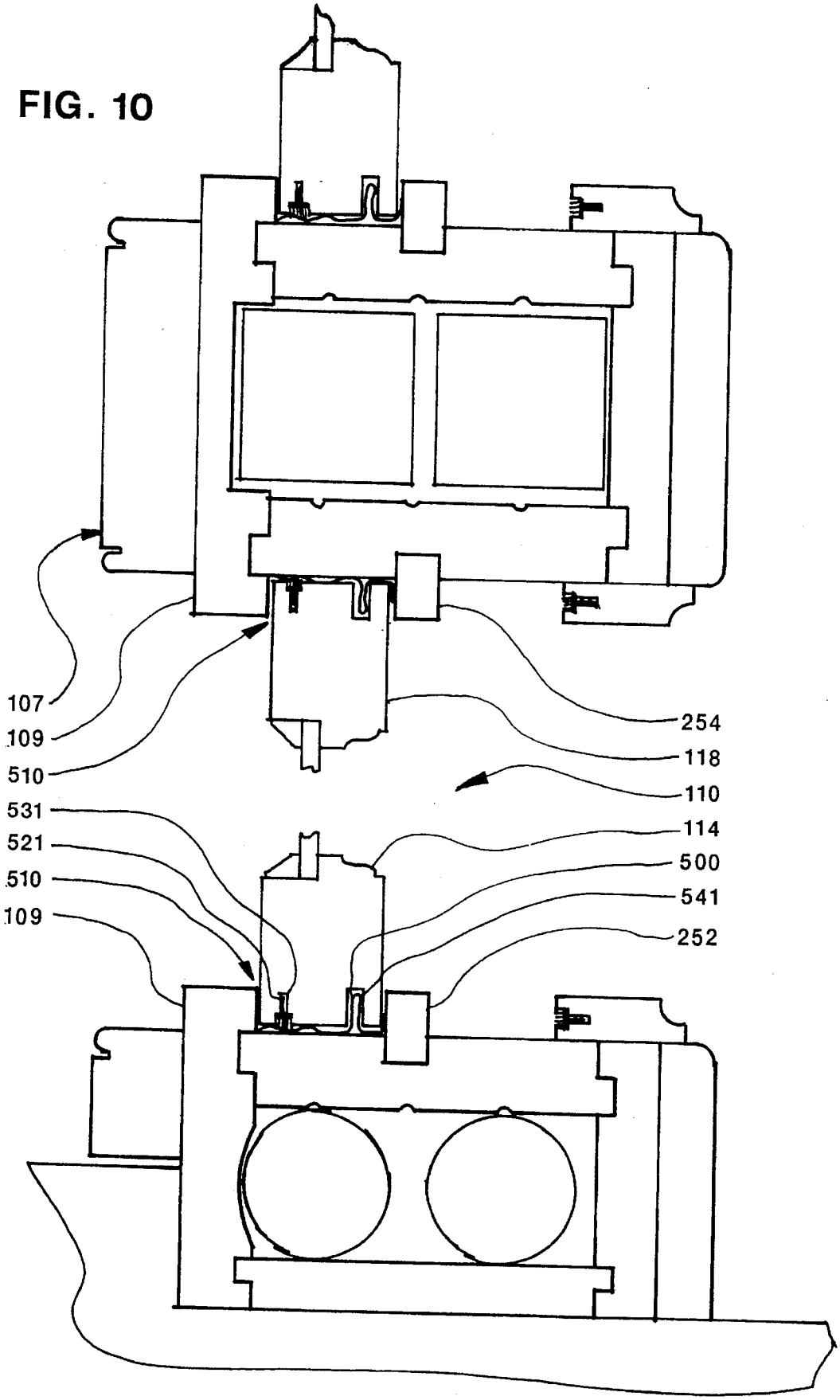
FIG. 10 is a cross-sectional view of the double-hung window closure of FIG. 1 taken along an upper horizontal axis 10—10' and illustrates a portion of a preferred weatherstripping combination arrangement of the present invention.

Turning now to vertically oriented arrangements, FIG. 10 is a cross-sectional view of the double-hung window closure of FIG. 1 taken along an upper horizontal axis 10—10' and illustrates a portion of a preferred weatherstripping combination arrangement of the present invention.

More particularly, in FIG. 10 there are illustrated the upper sash 110 shown in cross-section with respect to a mullion 107 with each of the stile sash member 114 and stile sash member 118 being disposed between a sash stop and a parting bead, i.e., the stile sash member 114 is slidingly disposed between the sash stop 109 and the left parting bead 252, and the stile sash member 118 is slidingly disposed between the sash stop 109 and the right parting bead 254, that is, within a vertical jamb channel 510. Both of the stile sash member 114 and stile sash member 118 have the same weatherstripping arrangement, and accordingly only one example thereof will be described with respect to the stile sash member 114 using the FIGS. 10, 11 and 12.

More particularly, FIG. 10 is as described above, and FIG. 11 is an enlarged, partial cross-sectional view of the double-hung window closure of FIG. 1 taken along a right portion of the upper horizontal axis 10—10' and illustrates a portion of a preferred weatherstripping combination arrangement of the present invention. FIG. 12 is an exploded view corresponding to FIG. 11 for the purpose of illustrating component parts and arrangements thereof in greater detail.

Illustrated with respect to the stile sash member 114 is a jamb metal weatherstrip 500 which is secured using, for example, an adhesive, nails, screws, etc., within the vertical jamb channel 510. The jamb metal weatherstrip 500 is arranged to have a substantially elongated metal weatherstrip contact body 501, a metal weatherstrip tongue 502 extending therefrom, a metal weatherstrip wrap-around portion 504, and metal weatherstrip ridges 505 and 506. The jamb metal weatherstrip 500 is preferably disposed along an entire top-to-bottom length of the jamb channel 510 in order to accommodate an up and down, opening and closing sliding action with respect to the stile sash member 114 and stile sash member 118, and thus the upper sash 110. Further, such weatherstrip component is preferably provided as a single unitary length without longitudinal joints or splices therealong, and is preferably made of a zinc material for weather resistance and durability, but may also be made of other metal and non-metal materials, e.g., molded plastic.

The jamb weatherstrip sliding groove 541 extends along an entire top-to-bottom vertical length of the stile sash member 114. The metal weatherstrip tongue 502 slidingly maintains the stile sash member 114, and accordingly the upper sash 110, along a vertical movement path within the vertical jamb channel 510 by engaging the jamb weatherstrip sliding groove 541 formed within the stile sash member 114. Preferably, the jamb weatherstrip sliding groove 541 has, in a cross-section transverse to a longitudinal axis thereof, a simple rectangularly-shaped groove which can be formed, e.g., using a router. Alternatively, the jamb weatherstrip sliding groove 541 may have a complex shape, e.g., a shape which facilitates a more interlocking relation with a complex-shaped metal weatherstrip tongue although such arrangement would be less preferable in that it would more likely cause window jams.

The metal weatherstrip tongue 502 is preferably arranged to have a slightly loose fit within the jamb weatherstrip sliding groove 541, but also may be slightly larger in width than the jamb weatherstrip sliding groove 541 to provide a more snug sliding engagement or can otherwise be biased to sealingly contact with one of the side surfaces and/or opening facing surface of the jamb weatherstrip sliding groove 541. A more tightly fitting metal weatherstrip tongue 502 has the advantages of providing both increased sealing and may reduce or eliminate the need for a counterbalancing sash weight.

The metal weatherstrip tongue 202 is preferably a simple hollow U or loop shape to afford slight flexibility thereto, but may also be solid and may also be of any other desired protruding shape.

The metal weatherstrip tongue 502 in a normal position within the jamb weatherstrip sliding groove 541 (as shown most clearly in FIG. 11) affords a first level of weather and draft resistance protection by serving as a barrier to weather and draft penetration by a sealing contact between the metal weatherstrip tongue 502 and the jamb weatherstrip sliding groove 541, or by representing an elongated path along which any weather or draft penetration must travel between an external and internal environment on opposing sides of the double-hung window 104.

Figure 11:
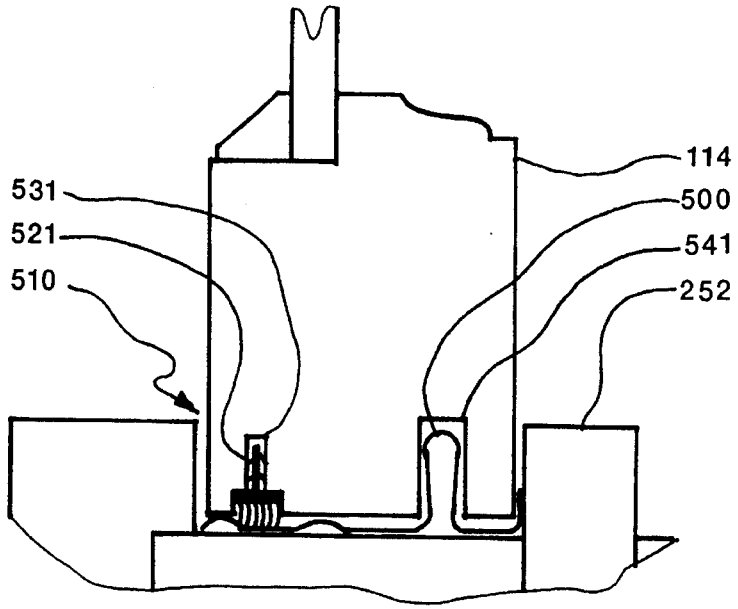
FIG. 11 is an enlarged, partial cross-sectional view of the double-hung window closure of FIG. 1 taken along a right portion of the upper horizontal axis 10—10' and illustrates a portion of a preferred weatherstripping combination arrangement of the present invention.
Figure 12:
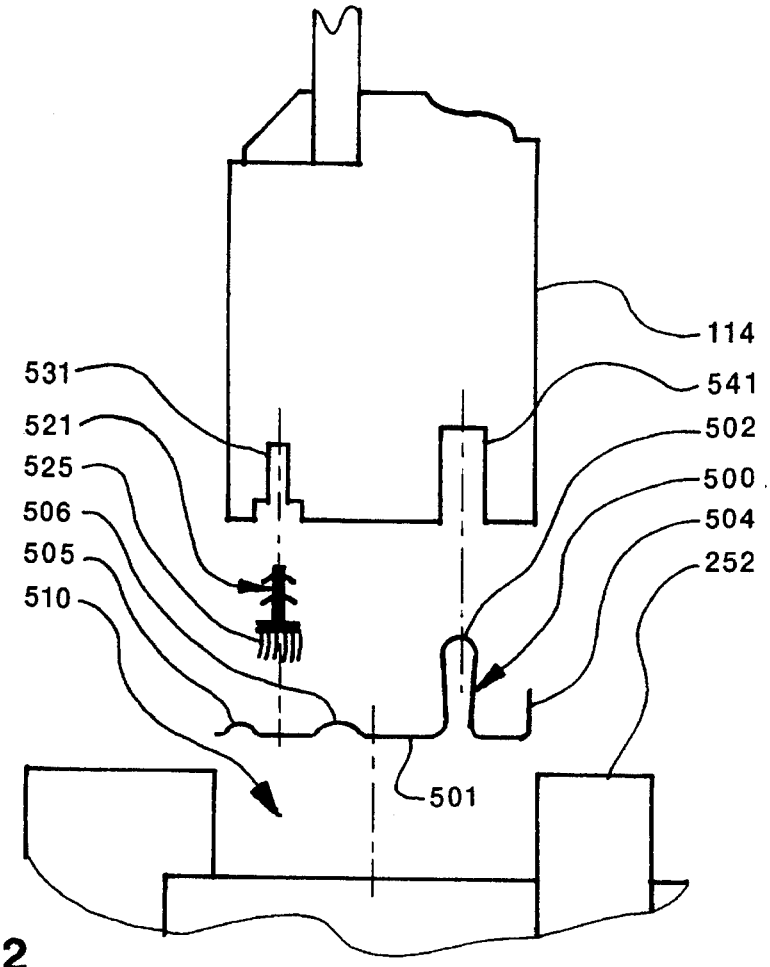
FIG. 12 is an exploded view corresponding to FIG. 11 for the purpose of illustrating component parts and arrangements thereof in greater clarity and detail.

Further shown in FIGS. 10, 11 and 12, is a stile pile weatherstrip seal 521 for insertion and retention within the stile pile weatherstrip retention groove 531 formed within the stile sash member 114. A description of the stile pile weatherstrip seal 521 and the stile pile weatherstrip groove 531 would substantially parallel the foregoing description with respect to the cap pile weatherstrip seal 421 and the cap pile weatherstrip retention groove 431, respectively, and accordingly, redundant discussion thereof is omitted for the sake of brevity.

The stile pile weatherstrip retention groove 531 is provided along an entire top-to-bottom vertical length of the stile sash member 114, and in a preferred embodiment, the stile pile weatherstrip seal 521 is also provided, preferably as a single unitary length without any longitudinal joint or splicing thereof, along an entire top-to-bottom vertical length of the stile sash member 114.

The pile seal bristles or protrusions 525 brushingly and slidingly travel along the metal weatherstrip contact body 501 in a valley defined between the metal weatherstrip ridges 505 and 506. The provision of the pile weatherstrip seal 525 being maintained between the metal weatherstrip ridges 505 and 506 enhances a sealing feature of the window along the stile sash member, whereas the protruding or raised metal weatherstrip ridges 505 and 506 represent surfaces upon which the stile sash member 114 can slide along.

In a preferred embodiment at the time of filing a patent application for the present invention, a preferred jamb metal weatherstrip is a commercially available weatherstrip, i.e., model #4CHX, called "SIDE WEATHERSTRIP", available from a manufacturer named ACCURATE METAL WEATHERSTRIP CO., INC. located in Mount Vernon, N.Y., and is retained within the jamb channel using ⅞" zinc nails. Further, a preferred stile pile weatherstrip seal is a commercially available weatherstrip, i.e., model #114WT, model name "KERF MOUNTED PILE", available from a manufacturer named Amesbury located at Amesbury, Mass., and is retained within the stile pile weatherstrip groove using a press fit.

The metal weatherstrip wrap-around portion 504 wraps around a comer or edge of the stile sash member 114 and thus maintains a thin protrusion of the stile sash member between the metal weatherstrip tongue 502 and the metal weatherstrip wrap-around portion 504. Such arrangement is advantageous in a first sense in that it allows an accurate positioning and maintenance of the upper sash 110 along a predetermined tight track and thus helps reduce rattling thereof, and in an second sense in that the close contacting between the metal weatherstrip wrap-around 504 and the stile sash member 114 affords a third level of weather and draft resistance protection along the top-to-bottom vertical length of the stile sash member 114.

The sliding contact, and thus the inherent friction, between opposing ones of the pile seal bristles 525, raised metal weatherstrip ridges 505, 506, metal weatherstrip contact body 501, upper sash 110 and the metal weatherstrip wrap-around portion 504 has the further advantage of possibly reducing or eliminating a need for a counterbalancing sash weight.

Figure 13:
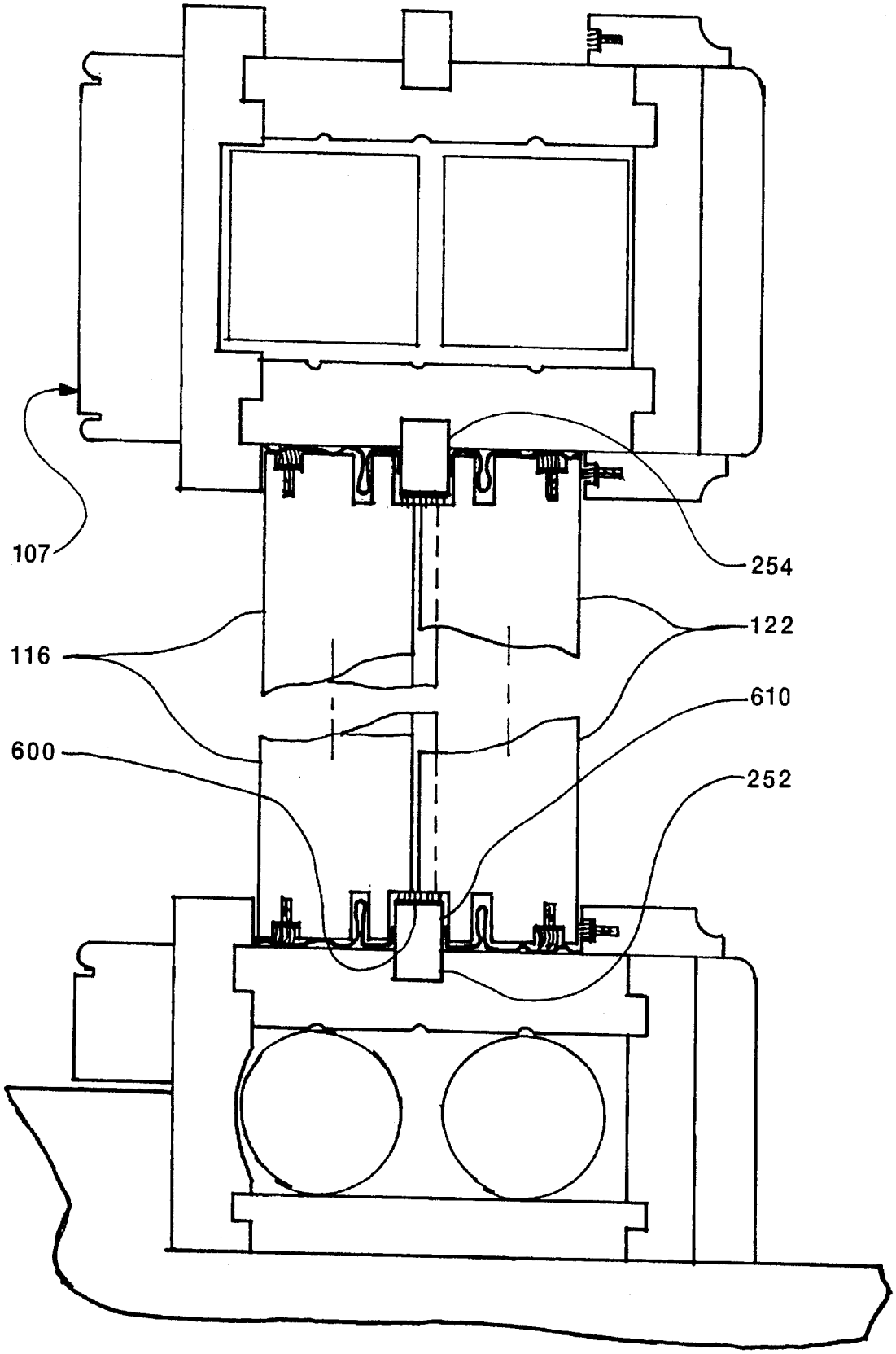
FIG. 13 is a cross-sectional view of the double-hung window closure of FIG. 1 taken along a mid horizontal axis 13—13' and illustrates a portion of a preferred weatherstripping combination arrangement of the present invention.
Figure 14:
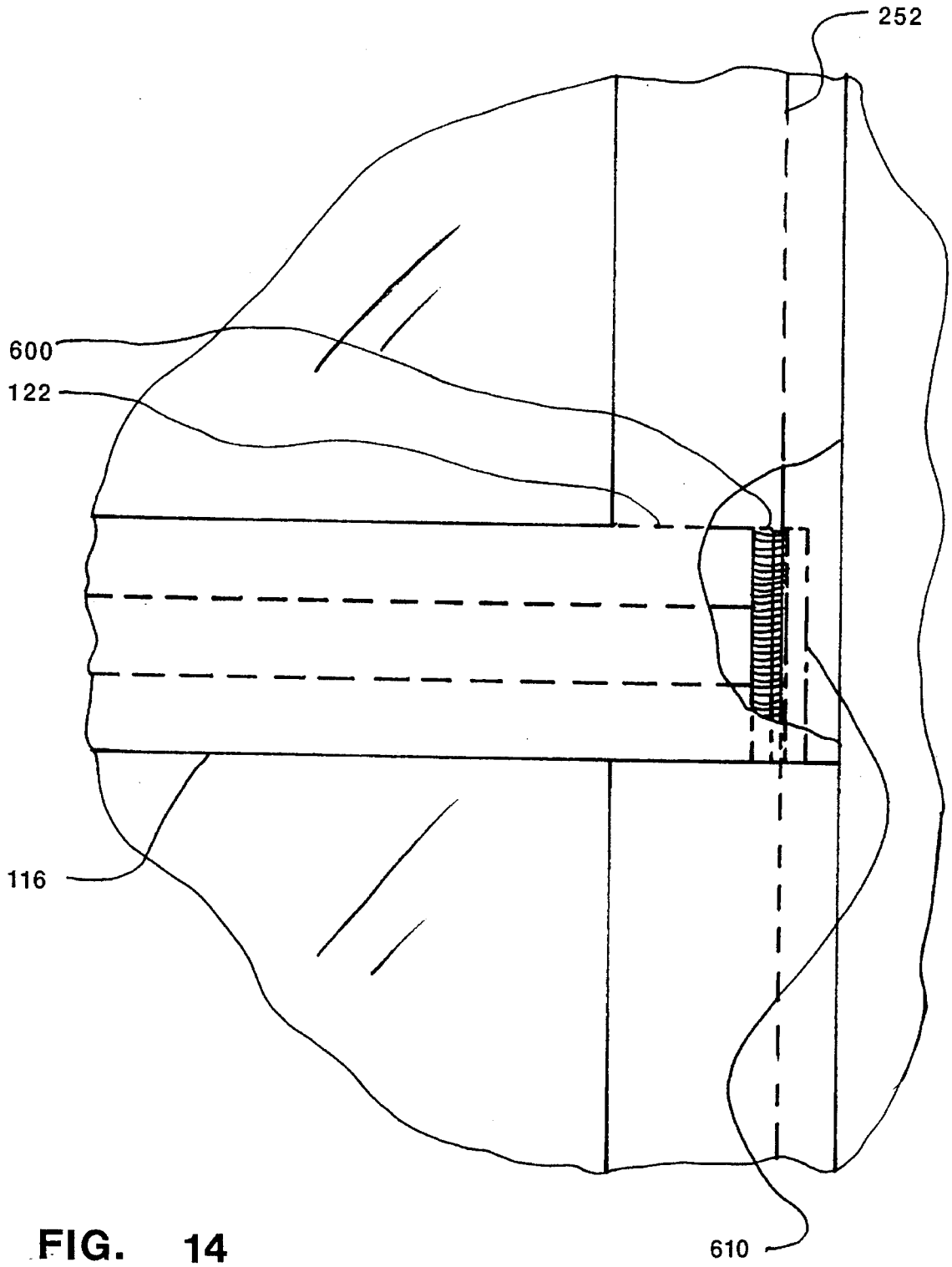
FIG. 14 is a partial cut-away and hidden line view corresponding to an emphasized area 14 of the double-hung window closure of FIG. 1 for the purpose of illustrating weatherstrip placement and other component parts and arrangements thereof in greater clarity and detail.
Figure 15:
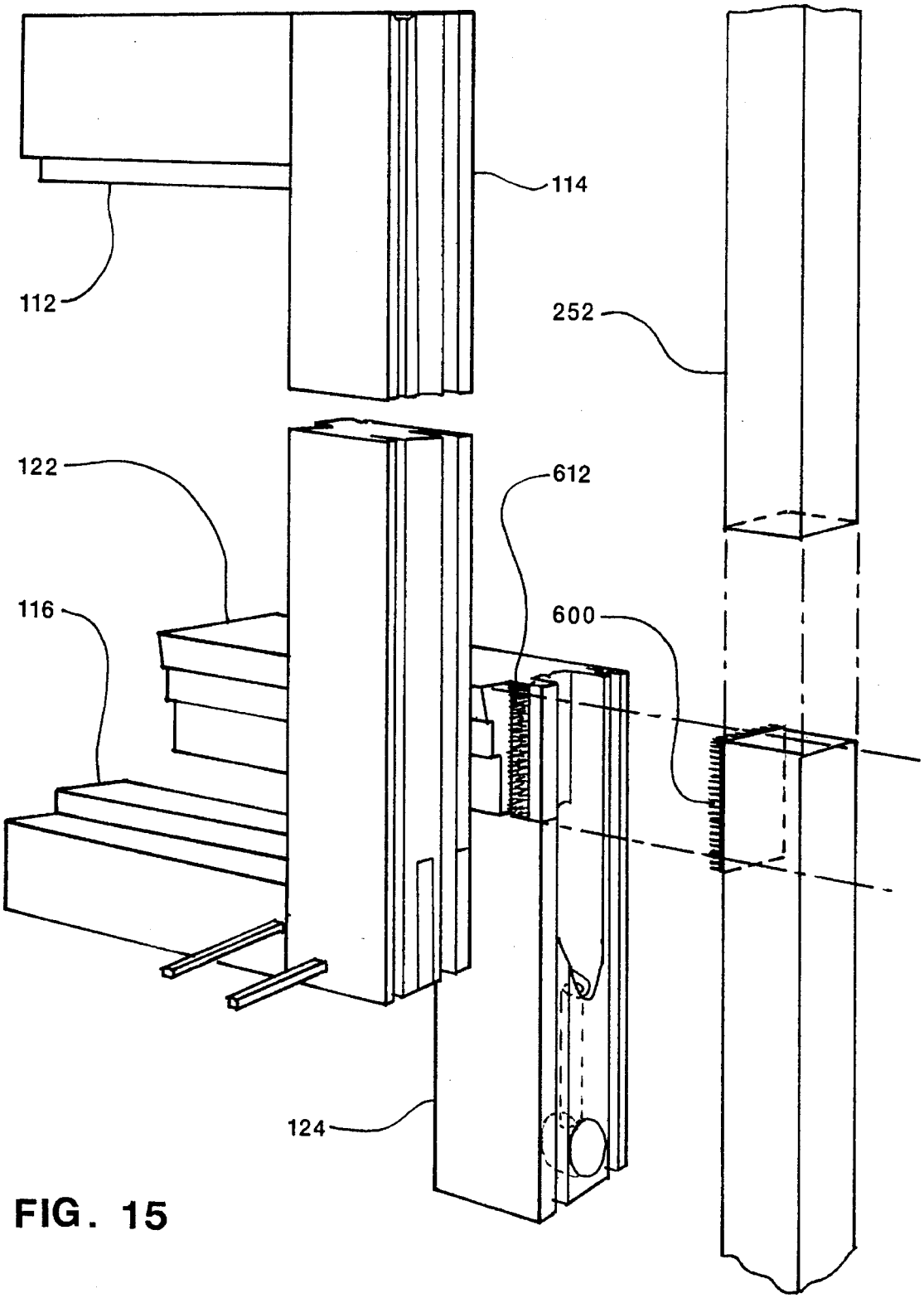
FIG. 15 is a perspective, partial sectional view of substantially a mid portion of the double-hung window closure of FIG. 1 for the purpose of illustrating weatherstrip placement and other component parts and arrangements thereof in greater clarity and detail.

Turning again to a disclosure of a weatherstripping arrangement with respect to a check rail portion, FIG. 13 is a cross-sectional view of the double-hung window closure of FIG. 1 taken along a mid horizontal axis 13—13' and illustrates a portion of a preferred weatherstripping combination arrangement of the present invention. As further relevant drawings, FIG. 14 is a perspective, partial cut-away and hidden line view corresponding to the emphasized area 14 of the double-hung window closure of FIG. 1, and FIG. 15 is a perspective, partial sectional view of substantially a mid portion of the double-hung window closure of FIG. 1, both for the purpose of illustrating weatherstrip placement and other component parts and arrangements thereof in greater clarity and detail.

More particularly, in FIG. 13, there are shown the check rail 116 and check rail 122 disposed with respect to the fight parting bead 252 and left parting bead 254. In a normally window closed and locked position, owing to required manufacturing tolerances and required window sliding clearances, there exits a gap between centrally facing surfaces of both the right parting bead 252 and left parting bead 254 with respect to opposing surfaces of the check rails 116 and 122, which gap would normally offer poor weather and draft resistance with respect to a check rail area of the window. Accordingly, in a preferred embodiment, a check rail pile weatherstrip 600 is disposed within such gap and is secured to each of the right parting bead 252 and left parting bead 254 using any well known securing approaches, e.g., through use of an adhesive, nails, screws, etc. A vertical height or length of the check rail pile weatherstrip 600 is preferably set to match a vertical length of the check rails 116 and 122 as most clearly illustrated in FIGS. 14 and 15. Such weatherstrip component is preferably provided as a single unitary length without longitudinal joints or splices therealong. Further, the bristles or protrusions of the check rail pile weatherstrip 600 preferably face and brushingly seal along the contacting surfaces of the check rails 116 and 122.

In a preferred embodiment at the time of filing a patent application for the present invention, a preferred check rail pile weatherstrip is a commercially available weatherstrip, i.e., model #4, called "DUST PLUG", available from a manufacturer named AMESBURY located in Amesbury, Mass., and is secured using a press fit and adhesive back.

A further gap 610 (see FIG. 13) may also exist between sides of the right parting bead 252 and the check rail 116 or left parting bead 254 and the check rail 122, with such gap 610 also representing an area of poor weather and draft resistance. If such is the case, a further check rail pile weatherstrip 612 can also be provided in a manner similar to that of the check rail pile weatherstrip 600 (see FIG. 15). In a preferred arrangement, the check rail pile weatherstrip 612 is secured to either the check rail 116 or check rail 122 such that the bristles brushingly seal against either of the right parting bead 252 or left parting bead 254. Again, the check rail weatherstrip 612 can be secured using any well known approach, e.g., through use of an adhesive, nails, screws, etc.

In a preferred embodiment at the time of filing a patent application for the present invention, a preferred check rail weatherstrip is a commercially available weatherstrip, i.e., model #5, called "DUST PLUG", available from a manufacturer named AMESBURY located at Amesbury, Mass., and is secured using an adhesive and ⅞" zinc nails.

Figure 16:
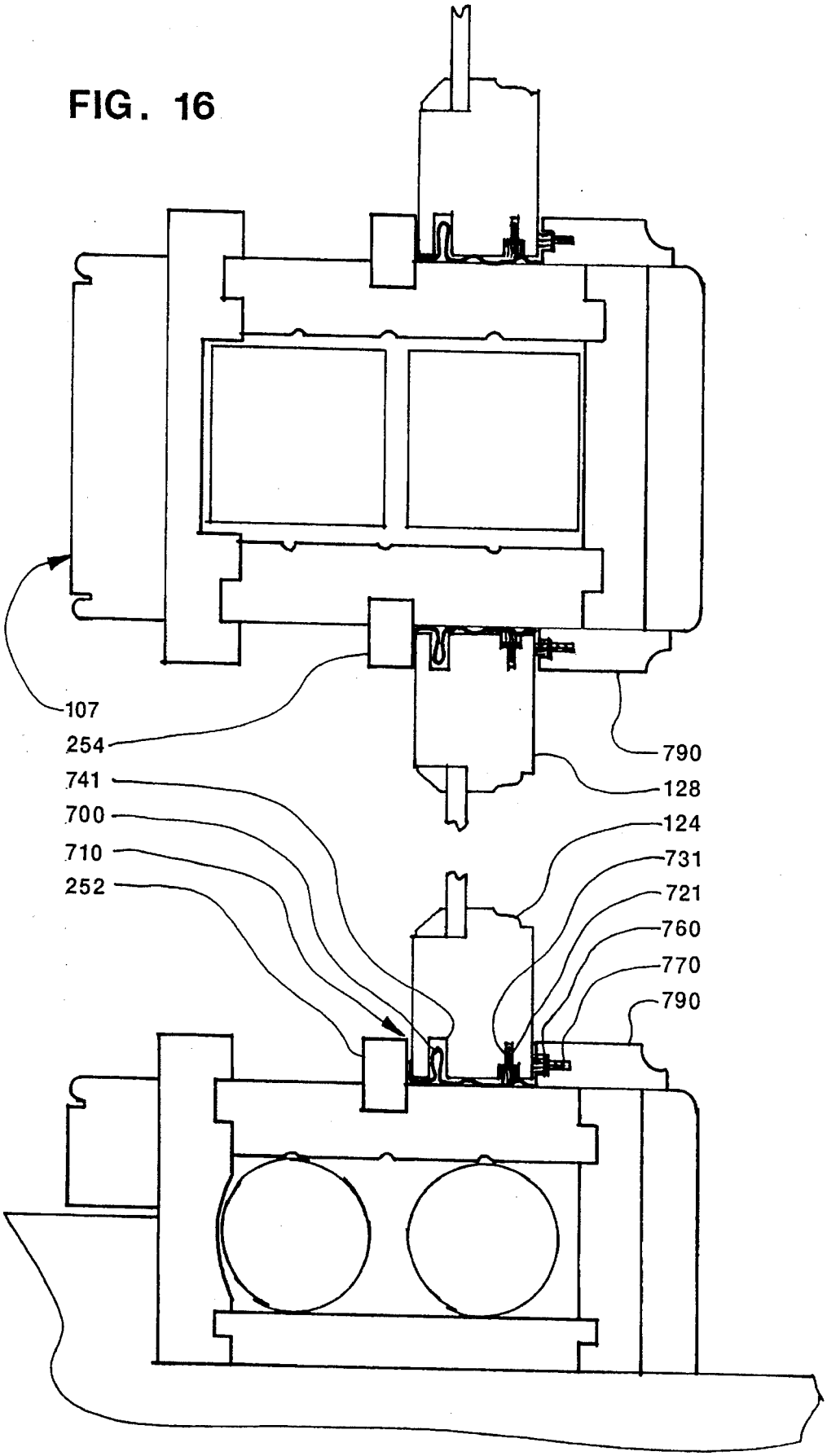
FIG. 16 is a cross-sectional view of the double-hung window closure of FIG. 1 taken along a lower horizontal axis 16—16' and illustrates a portion of a preferred weatherstripping combination arrangement of the present invention.
Figure 17:
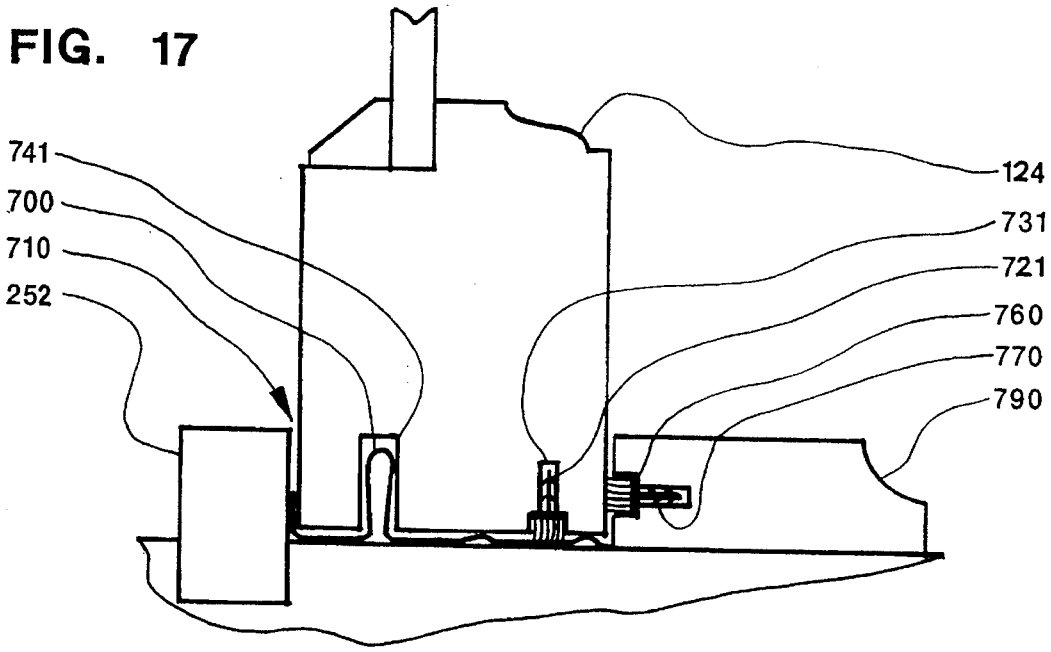
FIG. 17 is an enlarged, partial cross-sectional view of the double-hung window closure of FIG. 1 taken along a right portion of the lower horizontal axis 16–16' and illustrates a portion of a preferred weatherstripping combination arrangement of the present invention.
Figure 18:
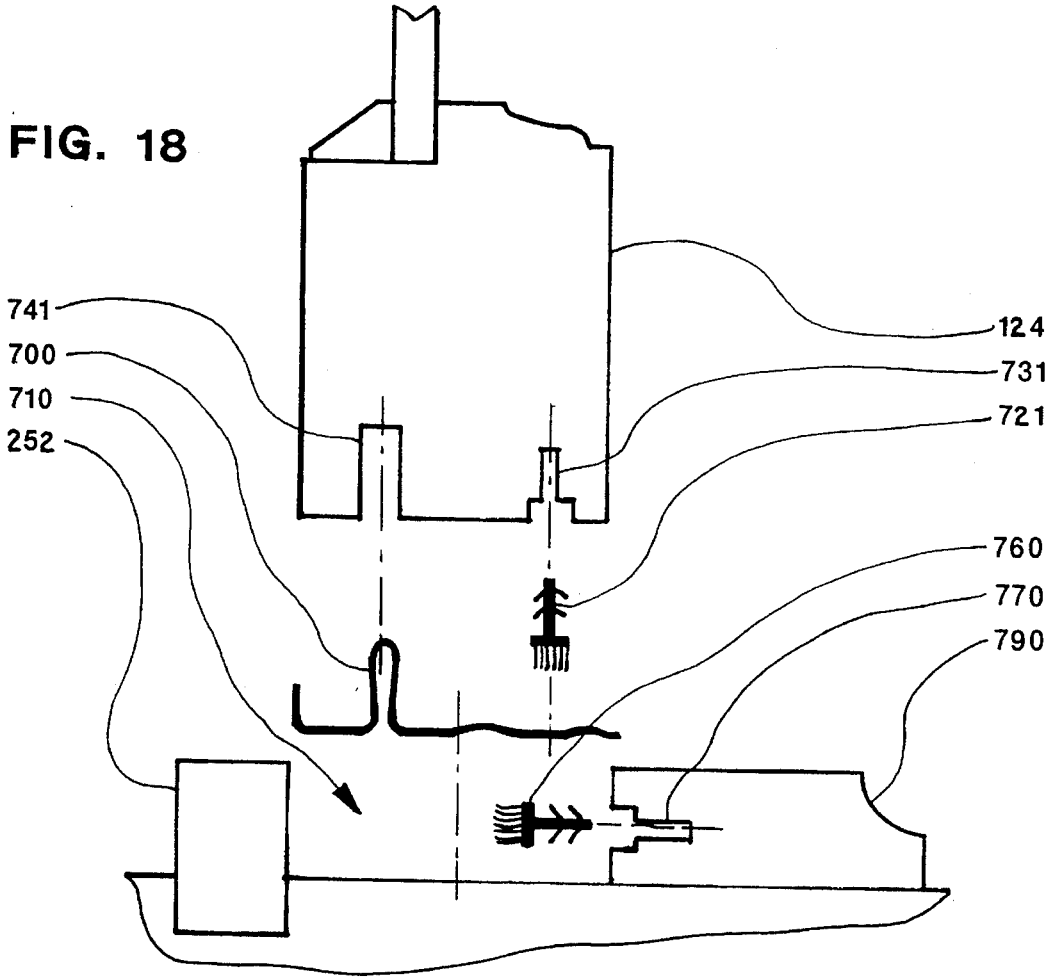
FIG. 18 is an exploded view corresponding to FIG. 17 for the purpose of illustrating component parts and arrangements thereof in greater clarity and detail.

The disclosure now turns to a description of the weatherstrip arrangement provided with respect to a lower sash 120. As drawings corresponding to such descriptions, FIG. 16 is a cross-sectional view of the double-hung window closure of FIG. 1 taken along a lower horizontal axis 16—16' and illustrates a portion of a preferred weatherstripping combination arrangement of the present invention, FIG. 17 is an enlarged, partial cross-sectional view of the double-hung window closure of FIG. 1 taken along a right portion of the lower horizontal axis 16—16' and illustrates a portion of a preferred weatherstripping combination arrangement of the present invention, and FIG. 18 is an exploded view corresponding to FIG. 17 for the purpose of illustrating component parts and arrangements thereof in greater clarity and detail. Both of the stile sash member 124 and stile sash member 128 have the same weatherstripping arrangement, and accordingly only one example thereof will be described with respect to the stile sash member 124.

More particularly, in FIG. 16, FIG. 17 and 18, there are shown the stile sash member 124, the stile sash member 128, the right parting bead 252, the left parting bead 54, a jamb metal weatherstrip 700, a jamb channel 710 (defined between either of the right parting bead 252 and the left parting bead 254 and the sash stop 790), a stile pile weatherstrip seal 721, a stile pile weatherstrip retention groove 731, and a jamb weatherstrip sliding groove 741. A discussion of the components 700, 710, 721, 731 and 741 would correspond exactly to the foregoing discussion with respect to the components 500, 510, 521, 531 and 541, respectively, and therefore, redundant discussion thereof is omitted for the sake of brevity. However, it should be noted that at least a portion of the aforementioned components 700, 710, 721,731 and 741 are provided in a layout which is mirrored from an arrangement/layout of the referenced components 500, 510, 521,531 and 541, with a mirror axis being defined along the fight parting bead 252 or left parting bead 254.

Further illustrated with respect to the FIGS. 16, 17 and 18 are a stop pile weatherstrip seal 760 retained within a stop pile weatherstrip retention groove 770 formed within a stop 790. The stop pile weatherstrip seal 760 is arranged such that the bristles thereof brushingly and sealingly contact opposing surfaces of the stile sash member 124, and is provided, preferably as a single unitary length without longitudinal joints or splices therealong, along an entire top-to-bottom length of the double-hung window 104 as defined between the transom 106 and sill 170. While the jamb metal weatherstrip 700 provides a first level, the stile pile weatherstrip seal 721 provides a second level, and a wrap-around portion of the jamb metal weatherstrip 700 provides a third level of weather and draft resistance protection, the stop pile weatherstrip 760 provides a fourth level of weather and draft resistance protection with respect to external and internal environments disposed on either side of the lower sash 120.

In a preferred embodiment at the time of filing a patent application for the present invention, a preferred stop pile weatherstrip seal is a commercially available weatherstrip, i.e., model #114WT, model name "KERF MOUNTED PILE", available from a manufacturer named AMESBURY located in Amesbury, Mass., and is retained within the pile weatherstrip retention groove using a press fit.

Figure 19:
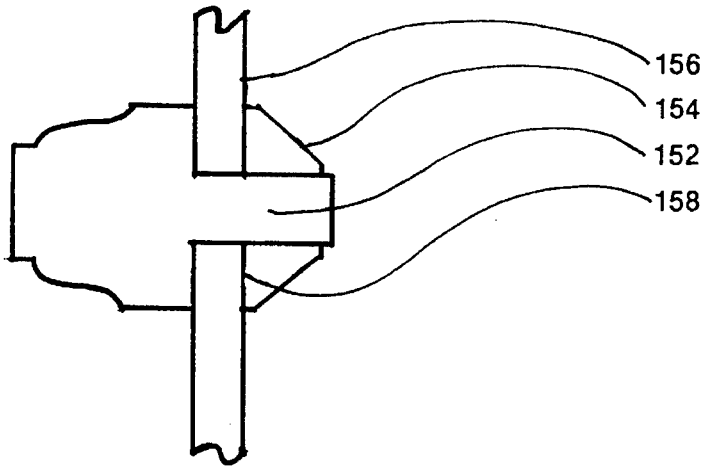
FIG. 19 is a partial cross-sectional view of an exemplary muntin arrangement and arrangement illustrating a caulking arrangement used with a preferred embodiment of the present invention.

FIG. 19 is a partial cross-sectional view illustrating a caulking arrangement used with a preferred embodiment of the present invention. More particularly, in FIG. 19, there are disclosed a cross-section of a muntin or sash bar 152, and muntin molding 154 retaining a window glass or window pane 156. In order to provide weather and draft resistance protection, a sealant or caulking 158 layer is provided between each of the muntin 152, muntin molding 154 and window glass 156. Such sealant or caulking 158 is preferably made of a silicone material.

In a preferred embodiment at the time of filing a patent application for the present invention, a preferred sealant or caulking is a commercially available product, i.e., model #GE 2801, model name "SILGLAZE", available from a manufacturer named GE located in Pittsfield, Mass.

This concludes the description of the preferred embodiments.

Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject weatherstripping combination arrangement within the scope of the foregoing disclosure, the drawings and the appended claims without departing from the spirit of the invention, e.g., the following represents a non-exhaustive list of modifications which might readily be apparent to one skilled in the art to which the present invention is directed: the transom resilient seal may be provided without the use of a resilient weatherstrip retention groove by simply adhering or nailing the resilient seal at a desired location, the transom resilient seal may contact and seal against the actual transom member instead of the transom metal weatherstrip, the transom resilient seal may be retained within the actual transom member instead of within the transom sash member, the hook metal weatherstrip and loop metal weatherstrip within the check rail weatherstrip gap may be substituted with a different type of weatherstrip and/or may be provided at a location other than the check rail weatherstrip gap In addition to variations and modifications in the component parts and/or arrangements, uses with alternative closures will also be apparent to those skilled in the art. More particularly, while the above disclosure has discussed applications of the subject weatherstripping combination arrangement with respect to double-hung window closures, it will be apparent to those skilled in the art that each of the subject weatherstripping combination arrangements are not so limited to such usage, but instead, could find application in a tremendous number of other closure uses, e.g., the weatherstripping combination arrangement disclosed above along the transom of a double-hung window closure, might have application along a transom of a single-hung window closure.

What is claimed and desired to be secured by Letters Patent of the United States is:

1. A window closure comprising:

a mating transom rigid weatherstrip provided between a transom and a transom sash member, a mating between said mating transom rigid weatherstrip and said transom sash member being provided at a first transom location on said transom sash member;

a transom flexible seal provided between said transom and said transom sash member at a second transom location with respect to said transom sash member different from said first transom location;

a mating jamb rigid weatherstrip provided between a jamb and stile sash members, a mating between said mating jamb rigid weatherstrip and said stile sash members being provided at a first stile location on said stile sash members;

a jamb flexible seal provided between said jamb and said stile sash member at a second stile location with respect to said stile sash members different from said first stile;

a mating sill rigid weatherstrip provided between a window sill and a sill sash member, a mating between said mating sill rigid weatherstrip and said sill sash member being provided at a first sill location on said sill sash member; and a sill flexible seal provided between said window sill and said sill sash member at a second sill location with respect to said sill sash member different from said first sill location.

2. A window closure as claimed in claim 1, wherein:

said mating transom rigid weatherstrip, said mating jamb rigid weatherstrip and said mating sill rigid weatherstrip are metal weatherstrips;

said transom flexible seal and said sill flexible seal are compressive resilient seals; and said jamb flexible seal is a pile seal.

3. A double-hung window closure comprising:

a transom metal weatherstrip having in cross-section, a transom protruding tongue portion, said transom metal weatherstrip being provided with respect to one of a transom and a transom sash member of an upper sash, and an opposite one of said transom and a transom sash member having a transom tongue receiving groove defined therein for insertably receiving said transom protruding tongue portion of said transom metal weatherstrip;

a transom resilient seal provided with respect to one of said transom and said transom sash member at a different location from a location of said transom protruding tongue portion and said transom tongue receiving groove, to provide a resilient seal between said transom and said transom sash member;

a first jamb metal weatherstrip having in cross-section, a first stile protruding tongue portion, said first jamb metal weatherstrip being provided with respect to one of a first jamb and upper right and left stile sash members of said upper sash, and an opposite one of said first jamb and said upper right and left stile sash members having a first stile tongue receiving groove defined therein for slidingly receiving said first stile protruding tongue portion of said first jamb metal weatherstrip;

a first stile pile seal provided with respect to one of said first jamb and said upper right and left stile sash members at a different location from a location of said first stile protruding tongue portion and said first stile tongue receiving groove, to provide a pile seal between said first jamb and said upper right and left stile sash members;

a check rail weatherstrip provided between a first check rail sash member of said upper sash and a second check rail sash member of a lower sash, to provide a seal therebetween;

a second jamb metal weatherstrip having in cross-section, a second stile protruding tongue portion, said second jamb metal weatherstrip being provided with respect to one of a second jamb and lower right and left stile sash members of said lower sash, and an opposite one of said second jamb and said lower right and left stile sash members having a second stile tongue receiving groove defined therein for slidably receiving said second stile protruding tongue portion of said second jamb metal weatherstrip;

a second stile pile seal provided with respect to one of said second jamb and said lower right and left stile sash members at a different location from a location of said second stile protruding tongue portion and said second stile tongue receiving groove to provide a pile seal between said second jamb and said lower right and left stile sash members;

a sill metal weatherstrip having in cross-section, a sill protruding tongue portion, said sill metal weatherstrip being provided with respect to one of a window sill and a sill sash member of said lower sash, and an opposite one of said window sill and said sill sash member having a sill tongue receiving groove defined therein for insertably receiving said sill protruding tongue portion of said sill metal weatherstrip; and a sill resilient seal provided with respect to one of said window sill and said sill sash member at a different location from a location of said sill protruding tongue portion and said sill tongue receiving groove to provide a resilient seal between said window Sill and said sill sash member.

4. A double-hung window closure as claimed in claim 3, wherein:

said transom metal weatherstrip and said transom resilient seal are respectively provided on opposite ones of said transom and said transom sash member;

said first jamb metal weatherstrip and said first stile pile seal are respectively provided on opposite ones of said first jamb and said upper right and left stile sash members;

said second jamb metal weatherstrip and said second stile pile seal are respectively provided on opposite ones of said second jamb and said lower right and left stile sash members; and said sill metal weatherstrip and said sill resilient seal are respectively provided on opposite ones of said window sill and said sill sash member.

5. A double-hung window closure as claimed in claim 3, further comprising:

a check rail pile seal provided with respect to at least one of said first check rail sash member, said second check rail sash member, and a separator bead between said first jamb and said second jamb, to provide a pile seal therebetween;

a stop pile seal provided with respect to one of a sash stop and said lower right and left stile sash members to provide a pile seal therebetween; and a pile cap seal provided with respect to one of a stool cap and said sill sash member to provide a pile seal therebetween.

6. A double-hung window closure comprising:

a transom metal weatherstrip having in cross-section, a main body portion and a protruding tongue portion, said transom metal weatherstrip being provided in a first transom channel;

a first jamb metal weatherstrip having in cross-section, a main body portion, a protruding tongue portion, a wrap-around portion provided substantially at one end of said main body, and at least two metal weatherstrip ridges provided along said main body and defining a valley therebetween, said first jamb metal weatherstrip being provided in a first jamb channel which is aligned with said first transom channel;

a second jamb metal weatherstrip having in cross-section, a main body portion, a protruding tongue portion, a wrap-around portion provided substantially at one end of said main body, and at least two metal weatherstrip ridges provided along said main body and defining a valley therebetween, said second jamb metal weatherstrip being provided in a second jamb channel which is aligned with a second transom channel;

a separator bead disposed between said first jamb channel and said second jamb channel;

a sill metal weatherstrip having in cross-section, a main body portion and a protruding tongue portion, said sill metal weatherstrip being provided along a window sill and being aligned with said second jamb channel;

an upper sash comprising a transom sash member, an upper right stile sash member, an upper left stile sash member and a first check rail sash member, said transom sash member having a tongue receiving groove defined therein for insertably receiving said protruding tongue portion of said transom metal weatherstrip, a transom resilient seal retention groove defined therein and a transom resilient seal provided with respect to said transom resilient seal retention groove, said transom resilient seal being compressively deformable between said transom sash member and said transom metal weatherstrip to provide a seal therebetween, said upper fight stile sash member and said upper left stile sash member each having a tongue sliding groove defined therein for slidingly receiving said protruding tongue portion of said first jamb metal weatherstrip, a first stile pile seal retention groove defined therein, a first stile pile seal provided with respect to said first stile pile seal retention groove, said first stile pile seal being slidable with respect to said valley defined in said first jamb metal weatherstrip and providing a pile seal between said first jamb metal weatherstrip and each of said upper fight stile sash member and said upper left stile sash member, and a stile sash portion disposed between said wrap-around portion and said protruding tongue portion of said transom metal weatherstrip, and said first check rail sash member having a rabbeted portion defined therein, and a first check rail weatherstrip provided with respect to said rabbeted portion;

a lower sash comprising a second check rail sash member, a lower right stile sash member, a lower left stile sash member and a sill sash member, said second check rail sash member having a second check rail weatherstrip, said second check rail weatherstrip for slidingly engaging said first check rail weatherstrip, said lower right stile sash member and said lower left stile sash member each having a tongue sliding groove defined therein for slidingly receiving said protruding tongue portion of said second jamb metal weatherstrip, a second stile pile seal retention groove defined therein, a second stile pile seal provided with respect to said second stile pile seal retention groove, said second stile pile seal being slidable with respect to said valley defined in said second jamb metal weatherstrip and providing a pile seal between said second jamb metal weatherstrip and each of said lower right stile sash member and said lower left stile sash member, and a stile sash portion disposed between said wrap-around portion and said protruding tongue portion of said second jamb metal weatherstrip, and said sill sash member having a tongue receiving groove defined therein for insertably receiving said protruding tongue portion of said sill metal weatherstrip, a sill resilient seal retention groove defined therein and a sill resilient seal provided with respect to said sill resilient seal retention groove, said sill resilient seal being compressively deformable between said sill sash member and said sill metal weatherstrip to provide a seal therebetween;

a check rail pile seal provided with respect to at least one of said separator bead, said first check rail sash member and said second check rail sash member to provide a pile seal between said separator bead and at least one of said first check rail sash member and said second check rail sash member;

a sash stop provided facing surfaces of said lower right stile sash member and said lower left stile sash member, said sash stop having a stop pile seal retention groove defined therein, a stop pile seal provided with respect to said stop pile seal retention groove, said stop pile seal providing a pile seal between said sash stop and each of said lower right stile sash member and said lower left stile sash member which are slidable with respect to said sash stop; and a stool cap provided adjacent said sill sash member, said stool cap having a cap pile seal retention groove defined therein, a cap pile seal provided with respect to said cap pile seal retention groove, said cap pile seal providing a pile seal between said stool cap and said sill sash member.

7. A double-hung window closure as claimed in claim 6, wherein said protruding tongue portion of said transom metal weatherstrip has a loose fit within said tongue receiving groove of said transom sash member.

8. A double-hung window closure as claimed in claim 6, wherein said protruding tongue portion of said transom metal weatherstrip has one of a width larger than a width of said tongue receiving groove of said transom sash member and a biased contacting posture, to sealingly contact with at least one of side surfaces and/or an opening facing surface of said tongue receiving groove of said transom sash member.

9. A double-hung window closure as claimed in claim 6, wherein said main body portion and said protruding tongue portion of said first transom metal weatherstrip have a substantially flat shape and a substantially U shape, respectively.

10. A double-hung window closure as claimed in claim 6, wherein said protruding tongue portion of said first jamb metal weatherstrip has a loose fit within said tongue receiving groove of said upper right stile sash member and said upper left stile sash member, and said protruding tongue portion of said second jamb metal weatherstrip has a loose fit within said tongue receiving groove of said lower right stile sash member and said lower left stile sash member.

11. A double-hung window closure as claimed in claim 6, wherein said protruding tongue portion of said first jamb metal weatherstrip has one of a predetermined width and a biased contacting posture to sealingly contact with at least one of side surfaces and/or an opening facing surface of said tongue receiving groove of said upper right stile sash member and said upper left stile sash member, and said protruding tongue portion of said second jamb metal weatherstrip has one of a predetermined width and a biased contacting posture to sealingly contact with at least one of side surfaces and/or an opening facing surface of said tongue receiving groove of said lower right stile sash member and said lower left stile sash member.

12. A double-hung window closure as claimed in claim 6, wherein said main body portion, said protruding tongue portion, said wrap-around portion and said at least two metal weatherstrip ridges of both said first jamb metal weatherstrip and said second jamb metal weatherstrip have a substantially flat shape, a substantially U shape, a substantially L shape and substantially hill shapes, respectively.

13. A double-hung window closure as claimed in claim 6, wherein a stile portion of each of said upper right stile sash member and said upper left stile sash member is maintained between said protruding tongue portion and said wrap-around portion of said first jamb metal weatherstrip and a stile portion of each of said lower right stile sash member and said lower left stile sash member is maintained between said protruding tongue portion and said wrap-around portion of said second jamb metal weatherstrip.

14. A double-hung window closure as claimed in claim 6, wherein said protruding tongue portion of said sill metal weatherstrip has a loose fit within said tongue receiving groove of said sill sash member.

15. A double-hung window closure as claimed in claim 6, wherein said protruding tongue portion of said sill metal weatherstrip has one of a predetermined width and a biased contacting posture, to sealingly contact with at least one of side surfaces and/or an opening facing surface of said tongue receiving groove of said sill sash member.

16. A double-hung window closure as claimed in claim 6, wherein said main body portion and said protruding tongue portion of said sill metal weatherstrip have a substantially flat shape and a substantially U shape, respectively.

17. A double-hung window closure as claimed in claim 6, wherein each of said transom resilient seal and said sill resilient seal has a resilient seal main body, resilient seal ridges provided along said resilient seal main body for sealingly contacting said transom metal weatherstrip and said sill metal weatherstrip, respectively, a resilient seal retention body extending from said resilient seal main body and having resilient seal retention arms supported thereon, said resilient seal retention arms engaging side walls of said transom resilient seal retention groove and said sill resilient seal retention groove, respectively, to retain said transom resilient seal and said sill resilient seal with respect to said transom sash member and said sill sash member, respectively.

18. A double-hung window closure as claimed in claim 6, wherein at least one of said first stile pile seal, said second stile pile seal, said stop pile seal and said cap pile seal has a pile seal main body, pile seal bristles provided extending from said pile seal main body and brushingly and sealingly contacting with surfaces of said first jamb metal weatherstrip, said second jamb metal weatherstrip, said lower right and left stile sash members and said sill sash member, respectively, a pile seal retention body extending from said pile seal main body and having pile seal retention arms supported thereon, said pile seal retention arms engaging side walls of said first stile pile seal retention groove, said second stile pile seal retention groove, said stop pile seal retention groove and said cap pile seal retention groove, respectively, to retain said first stile pile seal, said second stile pile seal, said stop pile seal and said cap pile seal with respect to said upper right and left stile sash members, said lower right and left stile sash members, said sash stop and said stool cap, respectively.

19. A double-hung window closure as claimed in claim 6, wherein:

said first stile pile seal has a first pile seal main body, first pile seal bristles provided along said first pile seal main body and sealingly contacting said first jamb metal weatherstrip, a first pile seal retention body extending from said first pile seal main body and having first pile seal retention arms supported thereon, said first pile seal retention arms engaging side walls of said first stile pile seal retention groove to retain said first stile pile seal with respect to said upper sash, and said second stile pile seal has a second pile seal main body, second pile seal bristles provided along said second pile seal main body and sealingly contacting said second jamb metal weatherstrip, a second pile seal retention body extending from said second pile seal main body and having second pile seal retention arms supported thereon, said second pile seal retention arms engaging side walls of said second stile pile seal retention groove to retain said second stile pile seal with respect to said lower sash.

20. A double-hung window closure as claimed in claim 6, wherein said first check rail weatherstrip and said second check rail weatherstrip have substantially a J cross-sectional shape and substantially a loop cross-sectional shape, respectively, and are provided within a gap defined between an abutting said first check rail sash member and said second check rail sash member; and wherein said check rail pile seal is arranged to be at least one of: A.) affixed to at least one surface of said separator bead facing a central vertical axis of said double-hung window closure, at a vertical position of said separator bead such that pile bristles of said check rail pile seal brushingly and sealingly contact with surfaces of said first check rail sash member and said second check rail sash member when said first check rail sash member and said second check rail sash member are in a normally window-closed position, and B.) affixed to at least one surface of at least one of said first check rail sash member and said second check rail sash member facing toward an opposite one of said first check rail sash member and said second check rail sash member, at a vertical position of said separator bead such that pile bristles of said check rail pile seal brushingly and sealingly contact with surfaces of said separator bead when in a normally window-closed position.

* * * * *